US007593657B2

(12) United States Patent
Takahashi et al.

(10) Patent No.: US 7,593,657 B2
(45) Date of Patent: Sep. 22, 2009

(54) POWDER TRANSFERRING DEVICE CAPABLE OF DETECTING AN AMOUNT OF THE POWDER

(75) Inventors: Tomoko Takahashi, Yokohama (JP); Youichiroh Miyaguchi, Yokohama (JP); Yoshinori Nakagawa, Yokohama (JP); Masaaki Yamada, Tokyo (JP); Nobuaki Kondoh, Yokohama (JP); Masanori Horike, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 544 days.

(21) Appl. No.: 11/493,816

(22) Filed: Jul. 27, 2006

(65) Prior Publication Data

US 2007/0025775 A1 Feb. 1, 2007

(30) Foreign Application Priority Data

Jul. 27, 2005 (JP) ..... 2005-216967

(51) Int. Cl.
*G03G 15/10* (2006.01)
*G03G 15/08* (2006.01)

(52) U.S. Cl. ..... 399/64; 399/289; 399/291

(58) Field of Classification Search ..... 399/55.61–64, 399/66, 266, 270, 271, 285, 289–291; 347/151
See application file for complete search history.

(56) References Cited

U.S. PATENT DOCUMENTS 5,574,539 A * 11/1996 Wong ..... 399/62
6,597,884 B2 7/2003 Miyaguchi et al.
6,708,014 B2 3/2004 Miyaguchi et al.
6,721,534 B2 4/2004 Takahashi
6,901,231 B1 5/2005 Sakai et al.
6,901,232 B2 * 5/2005 Sakuma et al. ..... 399/266
6,941,098 B2 9/2005 Miyaguchi et al.
6,947,691 B2 9/2005 Miyaguchi et al.
7,024,142 B2 4/2006 Sakai et al.
7,062,204 B2 6/2006 Miyaguchi et al.
7,187,892 B2 * 3/2007 Horike et al. ..... 399/252
2002/0158956 A1 * 10/2002 Van Der Meer et al. ..... 347/141
2004/0240907 A1 12/2004 Miyaguchi et al.
2005/0002054 A1 1/2005 Shoji et al.
2005/0025525 A1 2/2005 Horike et al.
2005/0063737 A1 * 3/2005 LeStrange et al. ..... 399/266
2005/0158073 A1 7/2005 Nakazato et al.

FOREIGN PATENT DOCUMENTS

JP 59093472 A * 5/1984

(Continued)

OTHER PUBLICATIONS

U.S. Appl. No. 11/734,389, filed Apr. 12, 2007, Aoki, et al.

(Continued)

*Primary Examiner*—Robert Beatty
(74) *Attorney, Agent, or Firm*—Oblon, Spivak, McClelland, Maier & Neustadt, L.L.P.

(57) ABSTRACT

A powder transferring apparatus provided with a powder electrostatic transferring device includes a plurality of transferring electrodes configured to generate an electric field for transferring the powder by an electrostatic force including a powder transferring amount detecting device to detect an amount of powder on a surface of the powder electrostatic transferring device.

3 Claims, 17 Drawing Sheets

FOREIGN PATENT DOCUMENTS

| | | | | |
|---|---|---|---|---|
| JP | 59-181371 | | | 10/1984 |
| JP | 59-189371 | | | 10/1984 |
| JP | 11052740 | A | * | 2/1999 |
| JP | 2002-258601 | | | 9/2002 |
| JP | 2003270949 | A | * | 9/2003 |
| JP | 2004-139038 | | | 5/2004 |
| JP | 2004-170796 | | | 6/2004 |
| JP | 2004-279829 | | | 10/2004 |

OTHER PUBLICATIONS

U.S. Appl. No. 12/140,032, filed Jun. 16, 2008, Ishii, et al.
U.S. Appl. No. 12/176,054, filed Jul. 18, 2008, Kadota, et al.

* cited by examiner

POWDER TRANSFERRING DEVICE CAPABLE OF DETECTING AN AMOUNT OF THE POWDER

BACKGROUND OF INVENTION

1. Field of Invention

This invention relates in general to an image forming apparatus capable of detecting an amount of powder on a surface of a powder electrostatic transferring device.

2. Discussion of the Background

An image forming apparatus, such as a copy machine, a facsimile, or a printer, etc., mentioned in Japanese Laid Open publication No. 2004-279829 and Japanese Laid Open publication No. 2004-139038, is known. In such an image forming apparatus, a latent image is formed on a latent image bearing member. Powder toner is adhered onto the latent image, and then the latent image is developed as a toner image. The toner image is transferred onto a recording medium, or onto an intermediate transfer medium and then onto a recording medium. In this way, an image is formed. In such an image forming apparatus, there is a developing device for developing the latent image. Conventionally, toner stirred within the developing device is transferred to a surface of a developing roller used as a developer bearing member, the toner is carried to a position facing the surface of the latent image bearing member, and the latent image on the latent image bearing member is developed by the toner. After the development is finished, toner not transferred to the latent image bearing member is recovered back to the developing device by the rotation of the developing roller, so that the toner is stirred and charged, and transferred to the developing roller again.

In this arrangement, the toner is sometimes rubbed between the developer bearing member and the latent image bearing member as the toners are moving on their surfaces, and is firmly fixed to one of the surfaces, adversely affecting the image. In addition, the toner is supposed to be moved electrostatically in the developing region by the electrical potential difference between the surface of the developer bearing member and the electrostatic latent image on the latent image bearing member, but this electrical difference must be fairly large. This is because a force, which is sufficient to overcome the adhesive force of the toner to the developer bearing member that results from van der Waals forces, image forces, or the like, must be imparted to the toner prior to the start of electrostatic movement for overcoming adherence to the developer bearing member. This requires a large electrostatic force.

On the other hand, it is known that in an image forming apparatus, as disclosed in Japanese Laid Open Publication No. 2004-170796, development of a latent image on a latent image bearing member is performed without a developer bearing member whose surface is moving. A development device in such an image forming apparatus has a toner electrostatic transporting substrate around which is arranged a plurality of transporting electrodes at intervals as a transporting electrodes loading device. In this arrangement, transportation of toner to the developing region using a toner electrostatic transporting substrate enables development with lower electric potential than using a developer bearing member whose surface is moving.

In addition, a developing apparatus requires a stable supply of toner for obtaining a stable image density.

Above mentioned Japanese Laid Open Publication 2004-279829 discloses development using a developer bearing member whose surface is moving, such as a developing roller or the like. In this document, to supply a stable amount of toner to a developing region, a pattern image is formed in non-image portion on a photo conductor, the density of the pattern image is detected, and the amount of toner supplied to the developing roller is adjusted based on the result of the detection.

On the other hand, in above mentioned Japanese Laid Open Publication 2004-139038, which discloses development using a toner electrostatic transporting substrate, to supply a stable amount of toner to a developing region, a pattern image is formed in a non-image portion on a photo conductor, the density of the pattern image is detected, and the amount of toner supplied to the toner electrostatic transporting substrate is adjusted based on the result of the detection also.

However, when an amount of toner is supplied to the developing region, there is a following drawback with the above method in which a pattern image is formed on a photo conductor for the detection. In fact, the amount of toner adherence is affected by an electrostatic characteristic of a photo conductor, conditions of charge and exposure, etc., not only by an amount of toner transported to the developing region. Consequently, for adjusting an amount of toner supplied to toner electrostatic transporting substrate, it is desirable that the amount of toner is supplied to the developing region. Further, not limited to case of transporting toner, such as a toner electrostatic transporting substrate, the ability to detect the amount of the transporting toner is desirable for a fine particle electrostatic transporting device which transports a fine particle by causing relative movement on the surface thereof.

SUMMARY OF THE INVENTION

Accordingly to the foregoing description, an object of the present invention is to provide a powder transferring apparatus provided with a powder electrostatic transferring device including a plurality of transferring electrodes to generate an electric field for transferring the powder by an electrostatic force. The apparatus includes a powder transferring amount detecting device to detect an amount of powder on a surface of the powder electrostatic transferring device.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

DESCRIPTION OF THE PREFERRED EMBODIMENT

Figure 1:
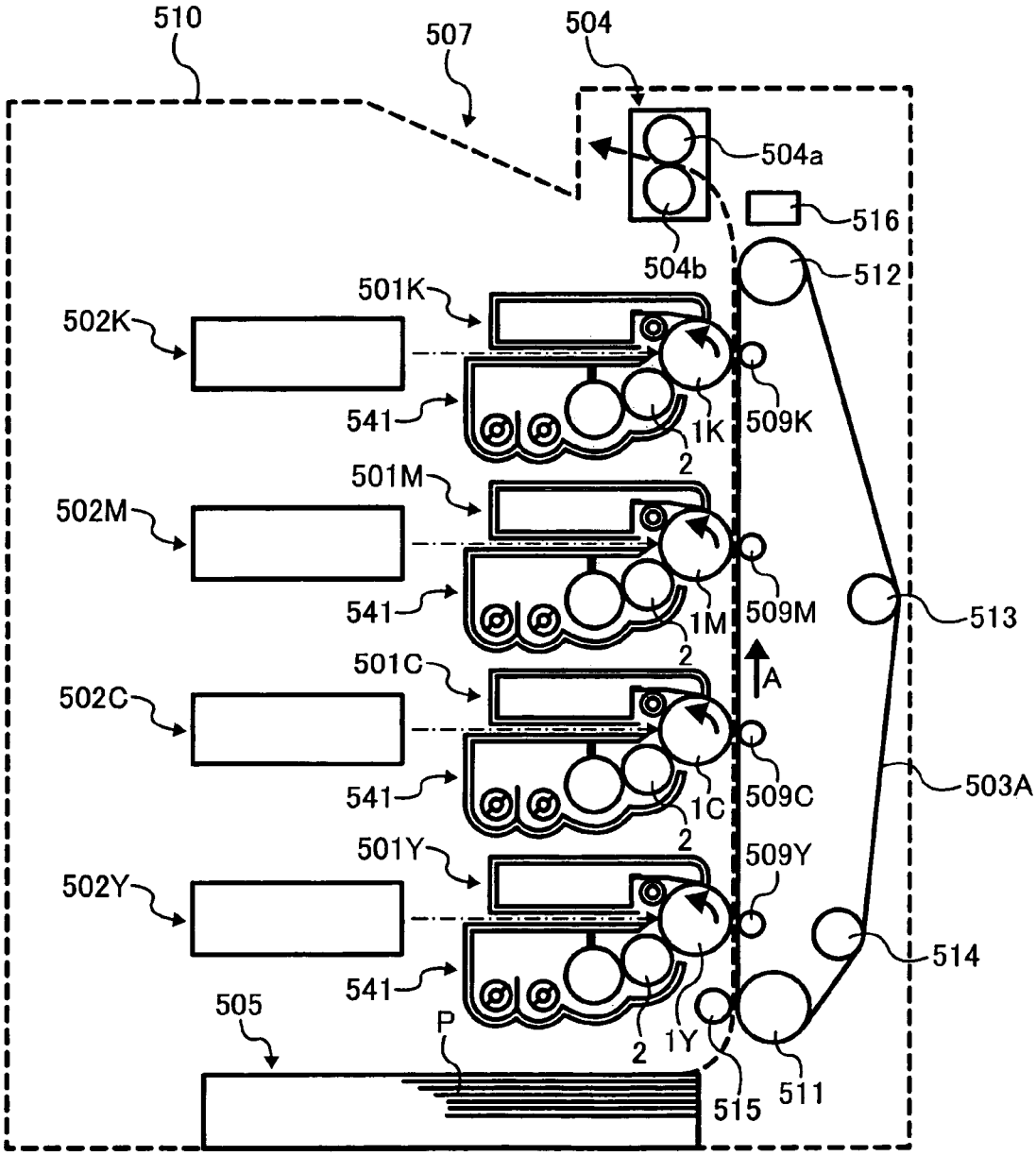
FIG. 1 shows a printer related to a first embodiment.

Embodiments of the present invention are described in detail accompanying the attached drawings. The first embodiment is an example in which the present invention is applied to a laser printer (hereinafter referred to as a printer 510). FIG. 1 schematically shows the printer 510 according to the first embodiment of the present invention.

The printer 510 has photo conductors 1K, 1M, 1C, and 1Y as image bearing members, a charging device, image processing units 501K, 501 M, 501C, and 501Y which each include a charging device, a developing apparatus 541 as a developing device, and a cleaning device for the image bearing member. The photo conductors 1K, 1M, 1C, and 1Y are arranged perpendicularly at the side of a recording medium transferring belt 503A as a recording medium transfer device which is under tension. Subscripts attached to these image processing units correspond to colors of toner processed by each unit. K, M, C, and Y mean black, magenta, cyan, and yellow respectively. Other devices or apparatuses in the printer 501 may include these subscripts in similar way. In what follows, when not distinguished by processed colors of toner, each unit is referred to as "image processing unit 501". Other devices or apparatuses are treated the same.

As shown in FIG. 1, the printer 510 includes writing apparatuses 502K, 502M, 502C, and 502Y located at the left sides of the image processing units 501K, 501M, 501C, and 501Y respectively, and transferring rollers 509K, 509M, 509C, and 509Y located on opposite sides of image processing unit 501K, 501 M, 501C, and 501Y from the recording medium transferring belt 503A respectively. The printer 510 includes a sheet feeding apparatus 505 which houses a transfer material P as recording medium below the recording medium transferring belt 503A, and a fixing apparatus 504 above the recording medium transferring belt 503A.

Writing apparatuses 502K, 502M, 502C, and 502Y write latent images to the surfaces of photo conductors 1K, 1M, 1C, and 1Y of the image processing units 501K, 501 M, 501C, and 501Y after charging according to the desired image. Various sorts of devices can serve as the writing apparatus, for example light scanning apparatuses using a polygon reflector, an LED array, etc.

The recording medium transferring belt 503A is tensioned by a transfer roller 511 and a driving roller 512, and tension rollers 513 and 514, and moved endlessly by the rotation of the transfer roller 511 in the direction depicted by arrow A. An adhering roller 515, which makes the transfer material P adhere to the recording medium transferring belt 503A, is located at a position opposite to the transfer roller 511. In addition, a P sensor 516, which detects a pattern when a toner image is formed on the recording medium transferring belt 503A, is located upward of the recording medium transferring belt 503A and on the side of the fixing apparatus 504.

The transferring rollers 509K, 509M, 509C, and 509Y opposite to photo conductors 1K, 1M, 1C, and 1Y via the recording medium transferring belt 503A include at least a cored bar and an electrically conductive elastic layer covering the cored bar. The electrically conductive elastic layer is made of an elastic layer adjusted to middle resistivity, whose electric resistance (volume resistance) is $10^6$-$10^{10}$ [Ω·cm] by combining and dispersing a conductivity imparting agent, such as carbon black, zinc oxide, or tin oxide, to elastic material, such as polyurethane rubber, ethylene-propylene-dien polyethylene (EPDM).

The fixing apparatus 504 includes a heat roller 504*a* and a pressure roller 504*b* opposite to the heat roller 504*a*.

In normal operation of the printer 510, the transfer material P supplied from the sheet feeding apparatus 505, such as a recording paper, adheres to the recording medium transferring belt 503A as the transferring device by applying a determined electric voltage to the adhering roller 515. The transfer material P supported on the recording medium transferring belt 503A moves together with the recording medium transferring belt 503A. As the material P moves, a toner image of each color is transferred to the transfer material P from the image processing units 501K, 501 M, 501C, and 501Y as an image processing device in series, and thus a color toner image is formed on the transfer material P. When the transfer material P reaches the fixing apparatus 504, the toner image on the transfer material P is heated as it is sandwiched between the heat roller 504*a* and pressure roller 504*b*. As a result, the toner image is fixed on the transfer material P, and thus a visible image is formed on the transfer material P. After that, the transfer material P, on which the color image is formed, is ejected to a copy receiving part 507 above the image processing unit 501.

In a mode for adjusting a color shift of each color toner image or toner density, the image processing units 501K, 501 M, 501C, and 501Y form a determined pattern of each toner directly on the recording medium transferring belt 503A. The P sensor 516 detects this toner pattern. Various kinds of adjustment, such as timing of writing, developing bias, etc., is implemented based on the result of detection. These operations lead to a condition which forms the optimum color image. The toner pattern remaining on the recording medium transferring belt 503A is recovered to the image processing units 501K, 501M, 501C, and 501Y by a bias applied to the transferring rollers 509K, 509M, 509C, and 509Y after adjusting the polarity of charging by a bias applied to the adhering roller 515.

Figure 2:
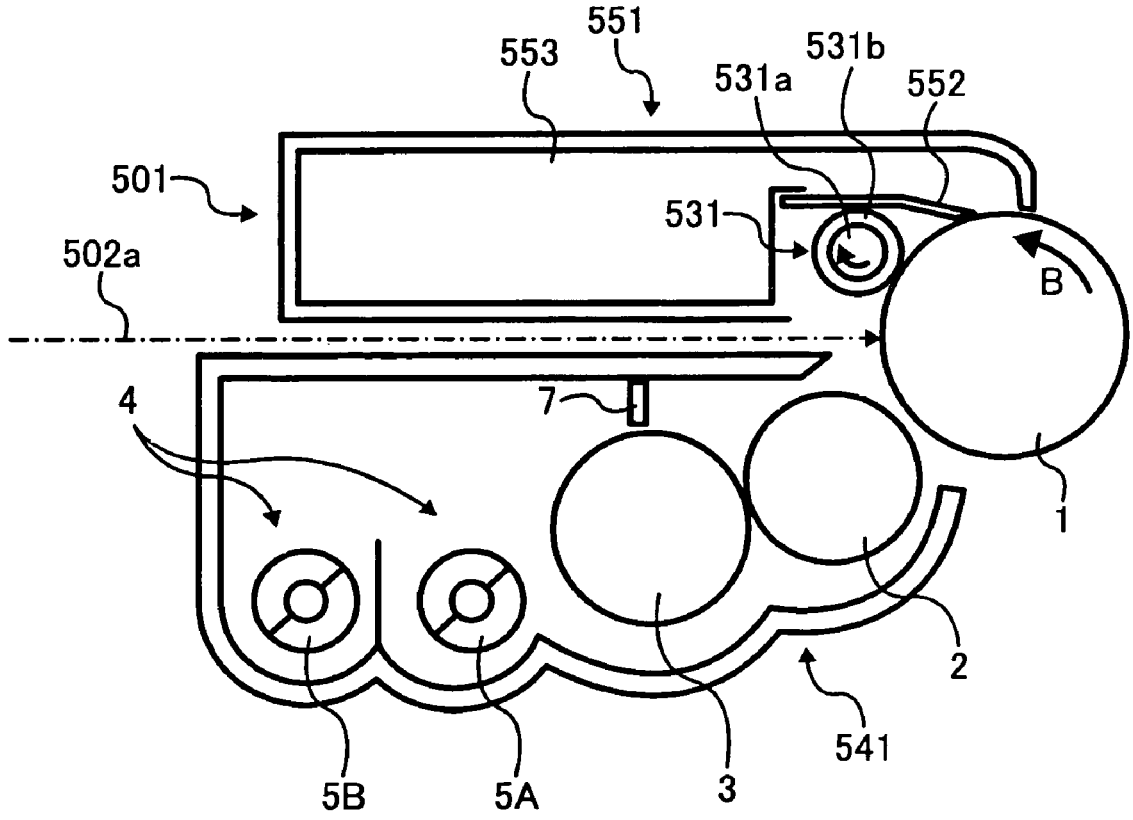
FIG. 2 shows an image processing unit of the printer.

Next, the image processing units 501K, 501 M, 501C, and 501Y are explained. FIG. 2 schematically shows one of the four image processing units 501K, 501M, 501C, and 501Y. The subscripts, which are attached to "501" are omitted for the four image processing units 501K, 501M, 501C, and 501Y. These units have the almost same construction except for the toner color which is used in each unit. The image processing unit 501 includes the photo conductor 1 as an image bearing member, a charging roller 531 as a charging device, which is a contact type charging device here, a developing apparatus 541, and a cleaning apparatus 551 as a cleaning device.

In addition, the image processing unit 501 has a removable architecture for the printer 510 as a process cartridge.

Figure 3:
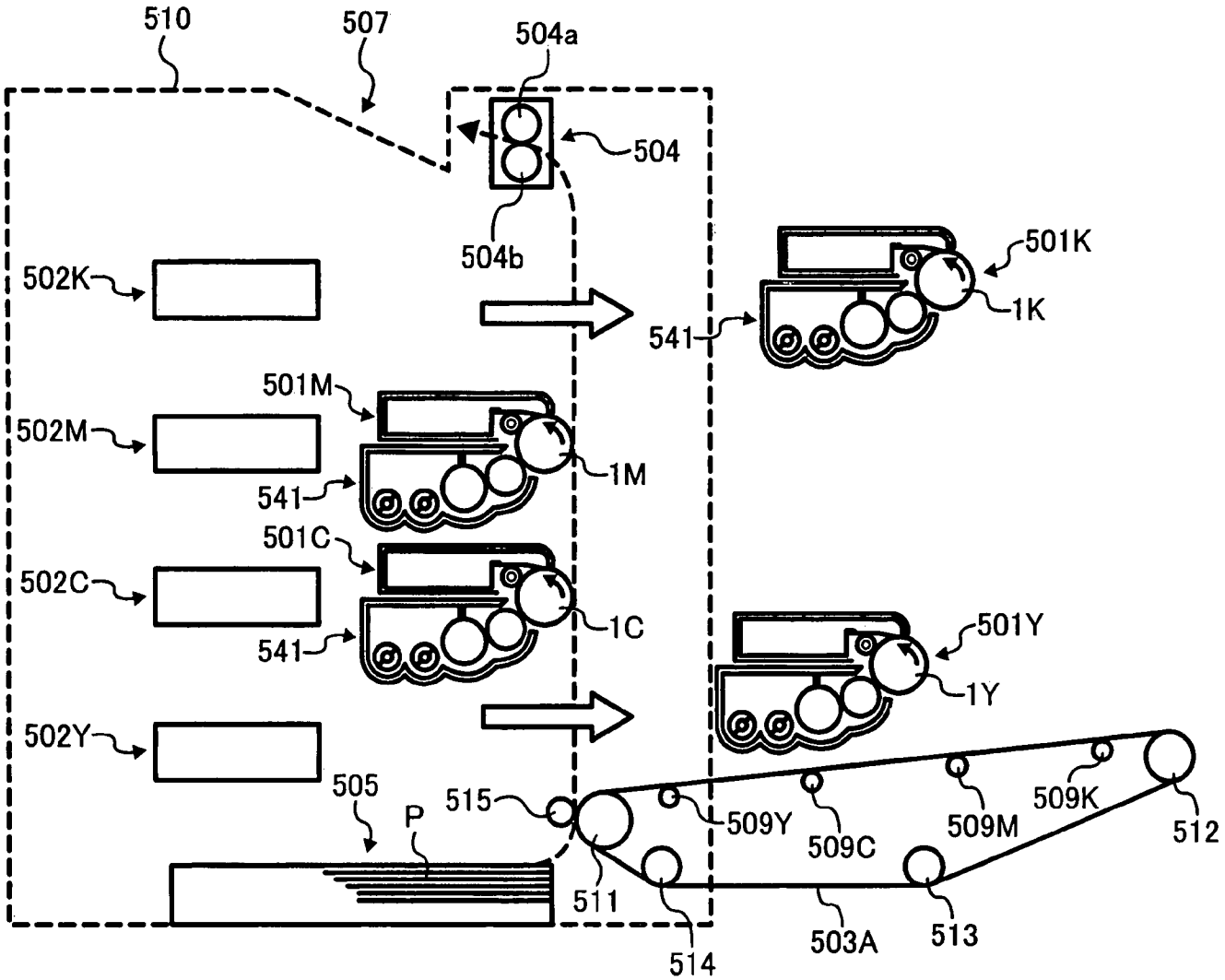
FIG. 3 shows an architecture for removal of the image processing unit of the printer.

FIG. 3 shows an architecture for removal of the image processing unit 501 as a process cartridge from the printer 510. As shown in FIG. 3, the recording medium transferring belt 503A is opened and removed from the printer 510. This structure enables the image processing unit 501 to be removed from the opened space, and then exchanged by user.

In FIG. 2, the photo conductor 1 is an organic photo conductor which can be charged negatively, and is implemented so as to rotate in the direction depicted by arrow B, in other words, anticlockwise rotation by a rotation driving mechanism (not shown).

The cleaning apparatus 551 includes a cleaning blade 552, which contacts the photo conductor 1 in a counter direction of the rotation direction of the photo conductor 1, and a waste toner storing part 553 which stores disposed toner particles as waste toner.

The charging roller 531 is a flexible roller formed of a urethane form layer 531*b*, which has a middle resistivity, formed in roller-shape on a roller core 531*a*. The urethane form layer 531*b* is synthesized from urethane resin, carbon black as a conductive particle, sulfating agent, and a foaming agent, etc. A material of the urethane form layer 531*b* is not limited to the above. A rubber material, which is synthesized by dispersing conductive material for adjusting resistivity, such as carbon black or metal oxide, within one of the exemplified below materials, and a material, which is synthesized by foaming the exemplified below materials, are also applicable: surethane; ethylene-propylene-dienepolyethylene (EPDM); butadiene-acrylonitrile rubber; silicone rubber; and isoprene rubber.

Next, image processing is explained.

The printer 510 is an image forming apparatus capable of acting as a copy machine and a printer. In a case where the image forming apparatus serves as a copier, image information loaded from a scanner (not shown) is converted to write data by treatment with various sorts of image data processing, for example, A/D exchange, MTF correction, gray-scale processing, and so on. In a case where the image forming apparatus serves as a printer, such image information as page-description language or bit-mapped image and so on, is converted to write data treated with various sorts of image data processing.

Before forming an image, the photo conductor 1 starts to rotate in the direction of the arrow B in FIG. 2, in other words anticlockwise rotation, in order that the surface movement speed reaches a determined level. The charging roller 531 rotates by being driven by the photo conductor 1. At this time, the roller core 531*a* of the charging roller 531 has a direct current voltage of −100V and an alternating voltage applied thereto by a charging bias applying power supply (not shown). Thus, the surface of the photo conductor 1 is charged to about −100V.

The writing apparatus 502 exposes the charged photo conductor 1 according to writing data. More specifically, changing an electric potential in the region of the image portion by illumination contrasts the potential difference of a non-image portion that is not illuminated. The electrostatic latent image is produced from this potential difference contrast.

The latent image formed on the photo conductor 1 by the writing apparatus 502 is developed by the developing apparatus 541, and formed on the photo conductor 1 as a toner image by adherence of toner particles to an image portion. In a case of development by a phase shift electric field, toner particles are transporting by hopping. When the particles come close the photo conductor 1, the particles are picked up and adhered to the image portion, and then the image is developed. In the printer 510, the electric field which leads toner particles from a supplying roller 3 to an electrostatic transporting roller 2, and from the charge roller 531 to the image portion on the photo conductor 1 by applying −50V to the electrostatic transporting roller 2 and −250V to the supplying roller 3.

The transfer material P is carried from the sheet feeding apparatus 505 as the toner image formed on the photo conductor 1 reaches the transfer portion where the transferring roller 509 and the photo conductor 1 face each other. The image on the photo conductor 1 is transferred to the transfer material P with pressure applied by the transferring roller 509. The transfer material P with the toner image transferred thereto is processed by the fixing apparatus 504, and then a color image is output onto the transfer material P.

On the contrary, untransferred toners which remain on the photo conductor 1 are cleaned up by the cleaning apparatus 551. The surface of the photo conductor 1 after cleaning is used for next image forming.

Next, the developing apparatus 541 is explained.

Figure 4:
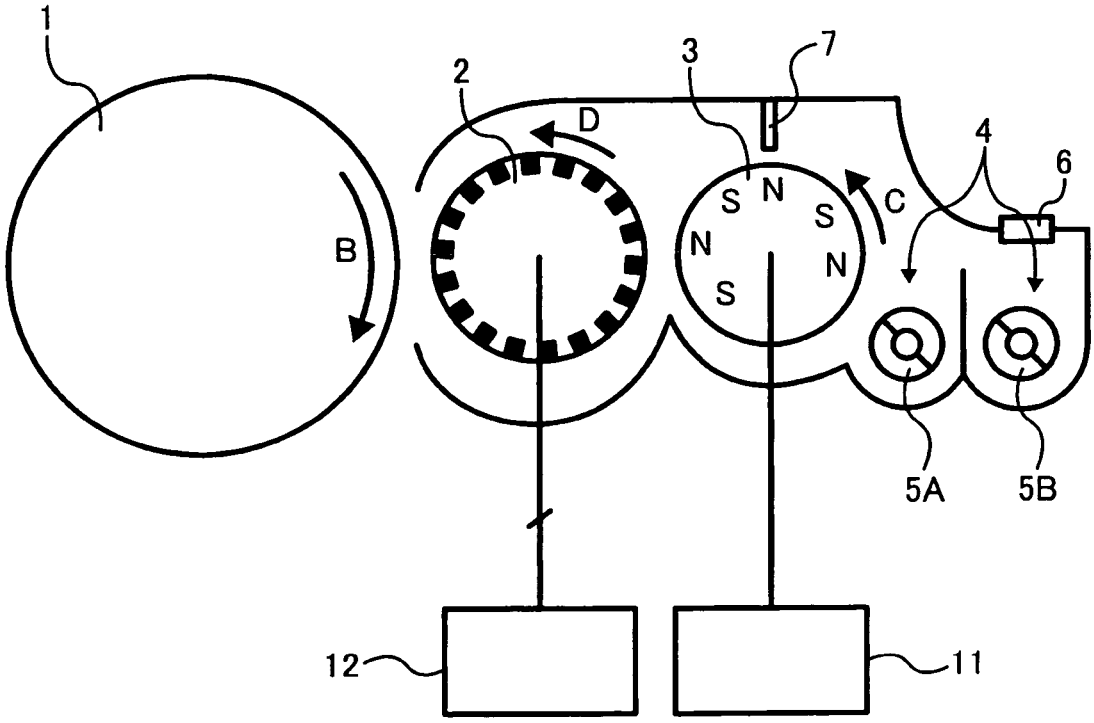
FIG. 4 shows the developing apparatus and the photo conductor related to the printer.

FIG. 4 schematically shows the developing apparatus 541 and the photo conductor 1.

The developing apparatus 541 is a kind of a development apparatus which uses a bi-component developer comprised of a magnetic carrier and a nonmagnetic toner. The developing apparatus 541 has the electrostatic transporting roller 2 which is a roller-shaped electrostatic transporting device including plural electrodes to generate an electric field for transporting, developing, and recovering toner particles. During image processing, the electrostatic transporting roller 2 is placed opposite the photo conductor 1 in a non-contacting state with a distance of 50-1000 micrometers therebetween, optimally 150-400 micrometers. In addition, the electrostatic transporting roller 2 includes the supplying roller 3 which is located at a position opposite to the electrostatic transporting roller 2 for supplying toner to the electrostatic transporting roller 2, and a developer storing part 4 which stores toner and a magnetic carrier supplied by the supplying roller 3. In this case, the electrostatic transporting roller 2 is located so as to face both of the photo conductor 1 and the supplying roller 3 through respective intermediary regions. Each region is placed on opposite side of the electrostatic transporting roller 2. In other words, the electrostatic transporting roller 2 is located between the photo conductor 1 and the supplying roller 3. The electrostatic transporting roller 2 does not rotate. On the external surface of the electrostatic transporting roller 2, toners are transported by the transporting electric field (phase shifted electric field) in the direction of the arrow depicted with the arrow D in FIG. 4. In contrast, the supplying roller 3 rotates in the direction of the arrow C in FIG. 4.

The developing apparatus 4 is divided into two spaces. These spaces are connected to each other via a path (not shown) for developer located at the both ends of the developing apparatus 541. The developing apparatus 541 contains the bi-component developer. The developer is carried inside the developing apparatus 4 with agitation by agitating and carrying screws 5A and 5B which are located inside each space.

In addition, the developing apparatus 4 includes a compensating port 6 for resupplying toner from a toner storing part (not shown). A toner density sensor for detecting magnetic permeability of developer is also located in the developing apparatus 4. The toner density sensor is used for detecting toner density. When toner density decreases, toner is resupplied to the developer storing part 4 through the compensating port 6.

The supplying roller 3 is located in a region opposite to the agitating and carrying screw 5A. The supplying roller 3 includes a settled magnet inside. The developer in the developer storing part 4 is drawn to the surface of the supplying roller 3 by the rotation and magnetic attraction of supplying roller 3.

A developer layer thickness controlling device 7 is located in a region opposite to the supplying roller 3. This region is downstream of the developer drawing region and upstream of the region where the supplying roller 3 faces the electrostatic transporting roller 2 along the rotating direction of the supplying roller 3 (indicated by the arrow C). The developer layer thickness controlling device 7 controls the developer drawn at the drawing region to a determined thickness. The developer which passes through the developer layer thickness controlling device 7 is carried to the region where the supplying roller 3 faces to the electrostatic transporting roller 2.

At this time, a supplying bias is applied to the supplying roller 3 by a supplying electric source 11 as the first charge applying device. An electric voltage is applied to the electrodes of the electrostatic transporting roller 2 by a transporting electric source 12 as the second charge applying device, described below.

Consequently, in the region where the supplying roller 3 and the electrostatic transporting roller 2 face each other, an electric field is generated between the supplying roller 3 and the electrostatic transporting roller 2 by the supplying electric source 11 and the transporting electric source 12. Under the influence of the electrostatic force from this electric field, toner separates from the carrier and moves to the surface of the electrostatic transporting roller 2. Then the toner which reaches the surface of the electrostatic transporting roller 2 is transported by hopping along the surface of the electrostatic transporting roller 2 by the transporting electric field generated by the electric voltage applied by the transporting electric source 12.

In addition, in the developing apparatus 541, a toner transporting apparatus, which serves as a fine particle transporting apparatus, includes the electrostatic transporting roller 2 and the transporting electric source 12.

The toner transported to the region where the toner faces the photo conductor 1 moves onto the photo conductor 1 and develops the latent image on the photo conductor 1 by the developing electric field between the electrostatic transporting roller 2 and the image portion on the photo conductor 1.

In this manner, in the developing apparatus 541 which uses bi-component developer comprised of magnetic carrier and nonmagnetic toner, charging is stable because a toner is charged by contact friction with carrier. Furthermore, development with a bi-component developer is suitable for high-speed development because an amount of supplied toner is large when development is performed.

As a developing apparatus using an electrostatic transporting method, there is an EH (Electrostatic Transport & Hopping) development method which is suggested by the inventors of this invention. This method enables a developing apparatus capable of a high efficiency of development with low electric voltage for driving, and a process cartridge and an image forming apparatus including this developing apparatus. In addition, a developing apparatus and method capable of preventing toner waste, a process cartridge and an image forming apparatus including this developing apparatus, and an image forming method performing this method is obtained. Further, in this EH development method, more stable development becomes possible by using a transported toner detecting apparatus of the present invention.

The EH represents a phenomenon that powder receives the energy of phase-shifting fields and the energy is transformed into a kinetic energy, which moves the powder itself dynamically. The phenomenon includes the horizontal movement (transport) and vertical movement (hopping) of the powder by an electrostatic force. This phenomenon includes the powder gaining a velocity component in the transporting direction and hopping on the surface of an electrostatic transporting device, due to the phase-shifting fields. Hereinafter, a development utilizing the EH phenomenon is called EH development.

In separately describing the behavior of powder on a transporting device, hereinafter, the terms of "transport", "transport velocity", "transport direction" and "transport distance" are used for the powder moving in the horizontal direction to a substrate of the device. The terms "hopping", "hopping velocity", "hopping direction", and "hopping height (distance)" are used for the powder jumping up (moving) in the vertical direction on the substrate. "Transport and hopping" on the transporting device is generally called "transfer," and the "transporting" included in the terms "transporting apparatus" and "transporting substrate" is synonymous with "transfer".

Next, the electrostatic transporting roller 2 is explained.

Figure 5:
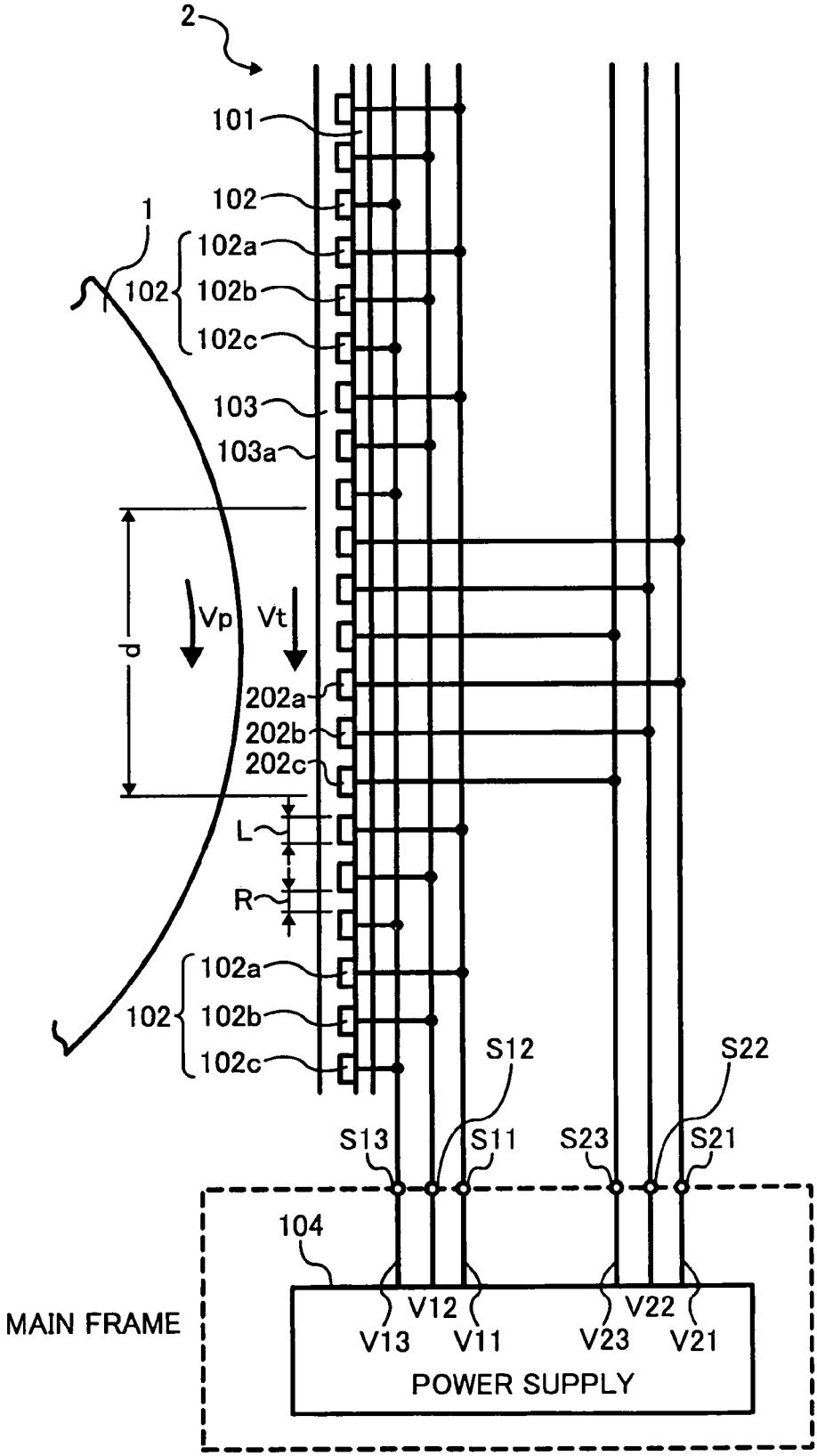
FIG. 5 shows the vicinity of a part where the electrostatic transporting roller faces the photo conductor.

FIG. 5 schematically shows the vicinity of a part where the electrostatic transporting roller 2 faces the photo conductor 1. In the electrostatic transporting roller 2, plural electrodes 102 are arranged on the supporting substrate 101 at intervals of R. In the printer 510, the driving voltage of three phases is applied. The electrodes 102 can be distinguished as below based on the difference of the applied phase: "the first electrode 102*a*"; "the second electrode 102*b*"; and "the third electrode 102*c*". In a situation where there is no need to distinguish the first electrode 102*a*, the second electrode 102*b*, the third electrode 102*c*, the term "the electrode 102" is used. The top of each electrode 102 is laminated with a surface protection layer 103 structured from inorganic or organic insulating material. The surface protection layer 103 serves as an insulating electrostatic transporting surface forming part that forms an electrostatic transporting surface 103*a*, and also as a protection layer covering the surface of each electrode 102.

As the noted above support substrate 101, the following sorts of substrate can be used: a substrate structured from insulating substrate, for example resin substrate or ceramic substrate; a substrate structured from substrate made from material having conducting properties, for example Steel USE Stainless (SUS), which is covered with insulting film, for example $SiO_2$; or a substrate structured from flexible material, for example polyimide film. The electrode 102 is formed by forming conductive material film 0.1-10 micrometers thick, optimally 0.5-2.0 micrometers thick, and then developing a desired pattern of electrodes, for example using photolithographic techniques. For example, Ni—Cr can be used as conductive material. The width L of the respective electrodes 102 in the transporting direction of powder is made 1 to 20 times the average diameter of the particles of traveling powder. The space R between each electrode 102 in the transporting direction of powder is also made 1 to 20 times the average diameter of the particles of traveling powder.

The surface protecting layer 103 is formed as a film comprised of such a substance as $SiO_2$, $TiO_2$, $TiO_4$, SiON, BN, TiN, or $Ta_2O_5$, where the thickness of the film is 0.5 to 10 μm, or desirably 0.5 to 3 μm.

In FIG. 5, lines leading out of the electrode 102 indicate conducting wires used to apply voltage to each electrode 102. Sites marked by a black circle of crossover sites indicate places connected electrically, and other sites indicate an insulation state. A power supply 104 of a main frame works so as to apply n-phased different driving voltages to each electrode 102. In this embodiment, it is explained that three phased driving voltages are applied (m=3). However, any natural number meeting m>2 may be used on the condition that toners are carried properly.

In this embodiment, each electrode 102 is connected to any of contact points S11, S12, S13, S21, S22, or S23 of the developing apparatus. S11, S12, S13, S21, S22, and S23 are connected respectively to the power supply 104, which provides driving waveforms V11, V12, V13, V21, V22, and V23 of the main frame in the condition that the developing apparatus 541 is loaded on the printer 510.

The electrostatic transporting roller 2 transfers toners to the proximity of the image bearing member 1. The electrostatic transporting roller 2 is divided into a development region used to form the toner image by adhering toner to the latent image on the image bearing member 1, and a transporting region used to recover toners that are transported to the transporting region without being used for development through the development region. The development region "d" exists only in the adjacent region to the image bearing member 1, and the transporting region exists in the whole area on the electrostatic transporting roller 2, except for the development region. In this embodiment, a region where toners are available to move by the phase-shifting electric field is referred to as an "electrostatic transporting surface". In this embodiment, the whole surface of the electrostatic transporting roller 2 is an electrostatic transporting surface.

In the transporting region, the first driving waveform V11 is applied to the first electrode 102*a*, the second driving waveform V12 is applied to the second electrode 102*b*, and the third driving waveform V13 is applied to the third electrode 102*c*. In the developing region, the first developing driving waveform V21 is applied to the first developing electrode 202*a*, the second developing driving waveform V22 is applied to the second developing electrode 202*b*, and the third developing driving waveform V23 is applied to the third developing electrode 202*c*.

Next, the principle of electrostatic transporting of toner with the electrostatic transporting roller 2 is described. Applying n-phased driving waveforms to pluralities of electrodes 102 of electrostatic transporting roller 2 generates the phase, shift electric field (traveling wave electric field) by the pluralities of electrodes 102. As a result, charged toners on the electrostatic transporting roller 2 move in the direction of transfer after receiving a repulsive force and/or an attractive force.

Figure 6:
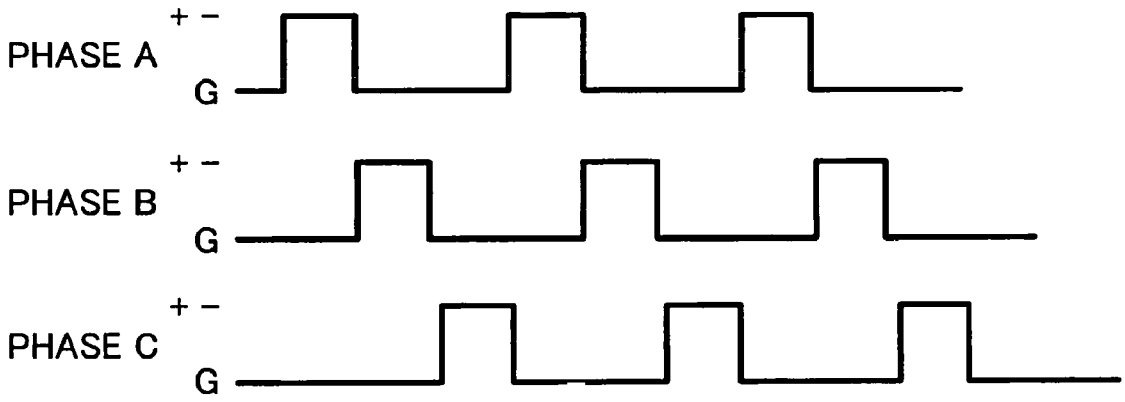
FIG. 6 is an explanatory drawing for describing waveforms when three driving pulse waveforms are applied in such a way that the timing of each waveform is shifted relative to each other.
Figure 7A:
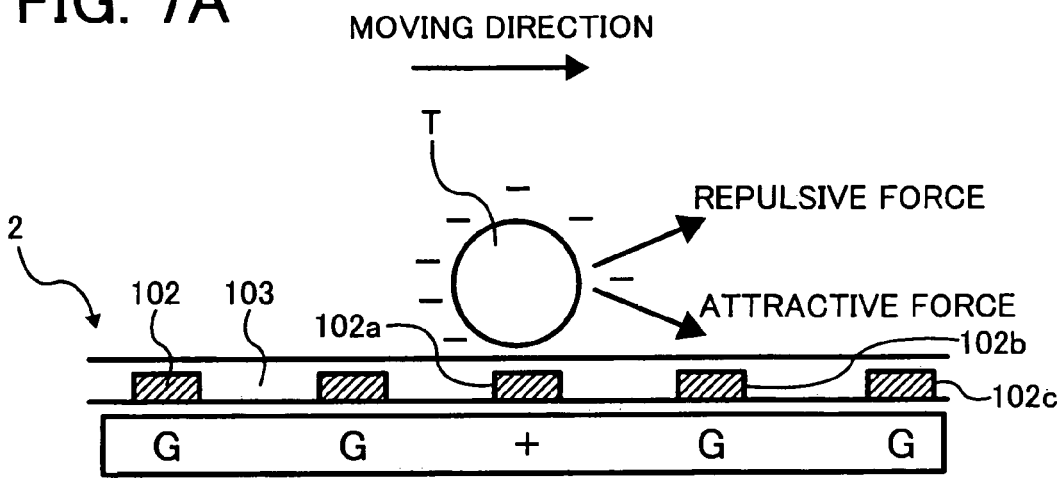
FIG. 7A is an explanatory drawing for describing a change in polarity applied to the plural electrodes at three timings in series.
Figure 7B:
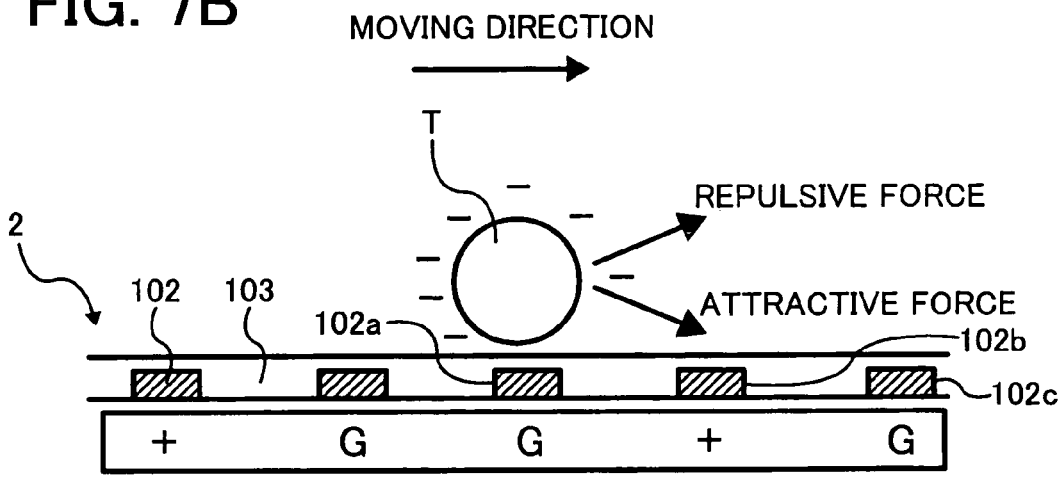
FIG. 7B is another explanatory drawing for describing a change in polarity applied to the plural electrodes at three timings in series.
Figure 7C:
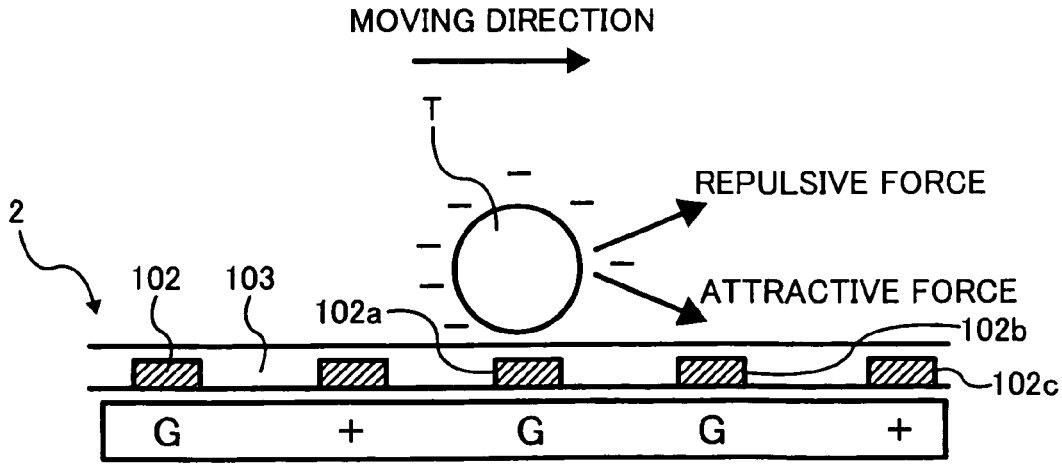
FIG. 7C is a further explanatory drawing for describing a change in polarity applied to the plural electrodes at three timings in series.

FIG. 6 is an explanatory drawing for describing driving waveforms when driving pulse waveforms phase A, phase B, and phase C. Each waveform shifts between the ground potential of G (0V) and a positive voltage, and are applied by the drive circuit to the electrodes 102 of the electrostatic transporting roller 2 in such a way that the applying timing of each waveform is shifted with respect to each other. FIG. 7A, FIG. 7B, and FIG. 7C are explanatory drawings for describing changes in polarity applied to the plural electrodes 102 at three timings. FIG. 7A, FIG. 7B, and FIG. 7C are a series when the driving waveforms shown in FIG. 6 are imposed.

As shown in FIG. 7A, FIG. 7B, and FIG. 7C, a negatively charged toner T is on the electrostatic transporting roller 2. If the consecutive electrodes 102 on the electrostatic transporting roller 2 are respectively applied with voltages "G", "G", "+", "G", and "G" as showing FIG. 7A, the negatively charged toner T is then positioned at the first electrode 102*a* that is applied with the positive voltage "+".

As shown in FIG. 7B, at the next timing, the electrodes 102 are respectively applied with voltages "+", "G", "G", "+", and "G". In particular, the voltage applied to the first electrode 102*a* is "G", and the voltage applied to the second electrode 102*a* is "+". Then the negatively charged toner T is subject to a repulsive force received from the first electrode 102*a* (with voltage "G") and an attractive force received from the second electrode 102*b* (with voltage "+"). As a result, the negatively charged toner T is moved towards the second electrode 102*b* (applied with the positive voltage "+").

Next, referring to FIG. 7C, at the next timing, the electrodes 102 are respectively applied with voltages "G", "+", "G", "G", and "+", the negatively charged toner T is, in common with FIG. 7B, subject to a repulsive force from the second electrode 102 *b* (with voltage "G") and an attractive force from the third electrode 102*c* (with voltage "+"). As a result, the negatively charged toner T is further moved towards the third electrode 102*c* (applied with the positive voltage "+").

FIGS. 8A-8D are explanatory drawings for describing the moving of toner by phase shift electric field.

Figure 8A:
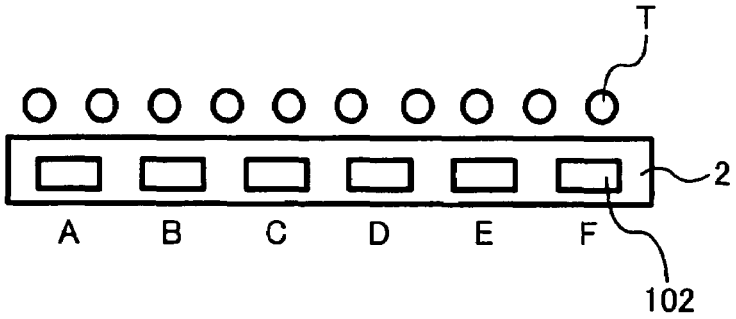
FIG. 8A is an explanatory drawing for describing the movement of toner by the shifting electric field.
Figure 8B:
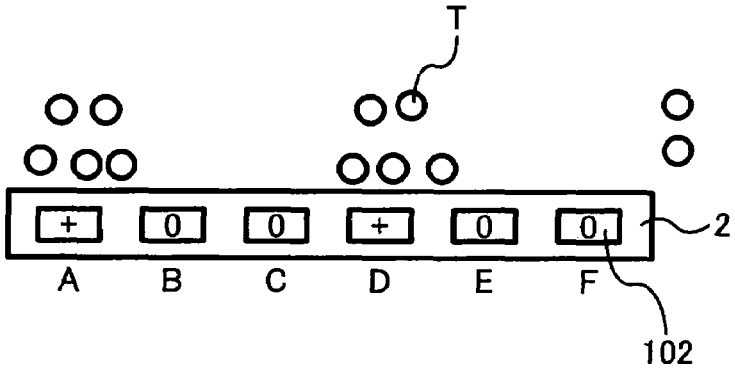
FIG. 8B is another explanatory drawing for describing the movement of toner by the shifting electric field.
Figure 8C:
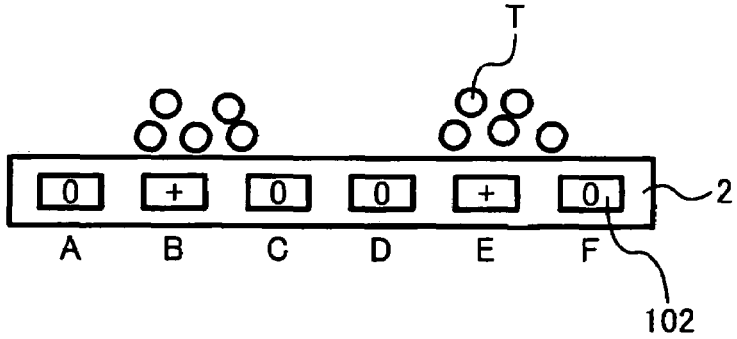
FIG. 8C is a further explanatory drawing for describing the movement of toner by the shifting electric field.
Figure 8D:
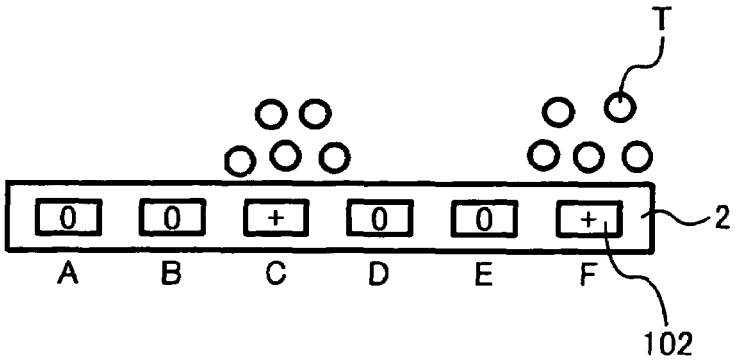
FIG. 8D is an additional explanatory drawing for describing the movement of toner by the shifting electric field.

FIG. 8A shows a state where the negatively charged particles of toner T are on the electrostatic transporting roller 2 when the electrodes A to F have no potential (G). When the electrodes A and D become positive, as shown in FIG. 8B, the negatively charged particles of toner T are attracted to the electrodes A, D and move onto them. Then, according to the prescribed timing, the voltage of both electrodes A, D become zero, as shown in FIG. 8C, while the electrodes B, E become positive. At this moment, the particles of toner T on the electrodes A, D are repelled by the electrodes A, D and attracted to the electrodes B, E, simultaneously, thus transferred to the electrodes B, E. Then, at another shift of waveforms, the voltage of both electrodes B, E become zero, as shown in FIG. 8D, while the electrodes C, F become positive. At this moment, the particles of toner T on the electrodes B, E are repelled by the electrodes B, E and attracted to the electrodes C, F, simultaneously, thus transferred to the electrodes C, F. In this manner, the negatively charged particles of toners are sequentially transferred to the right, as shown in FIG. 8A-FIG. 8D, by the traveling waveform fields.

As described above, when the multiphase drive waveforms with shifting voltages are applied to a plurality of the electrodes 102, the traveling waveform fields are generated on the electrostatic transporting roller 2, and the negatively charged toner T is transferred as it hops in the transporting direction of the traveling waveform fields. It will be appreciated that when the toner is positively charged, reversing the shifting pattern of the drive waveforms brings the same result as described above.

Figure 9:
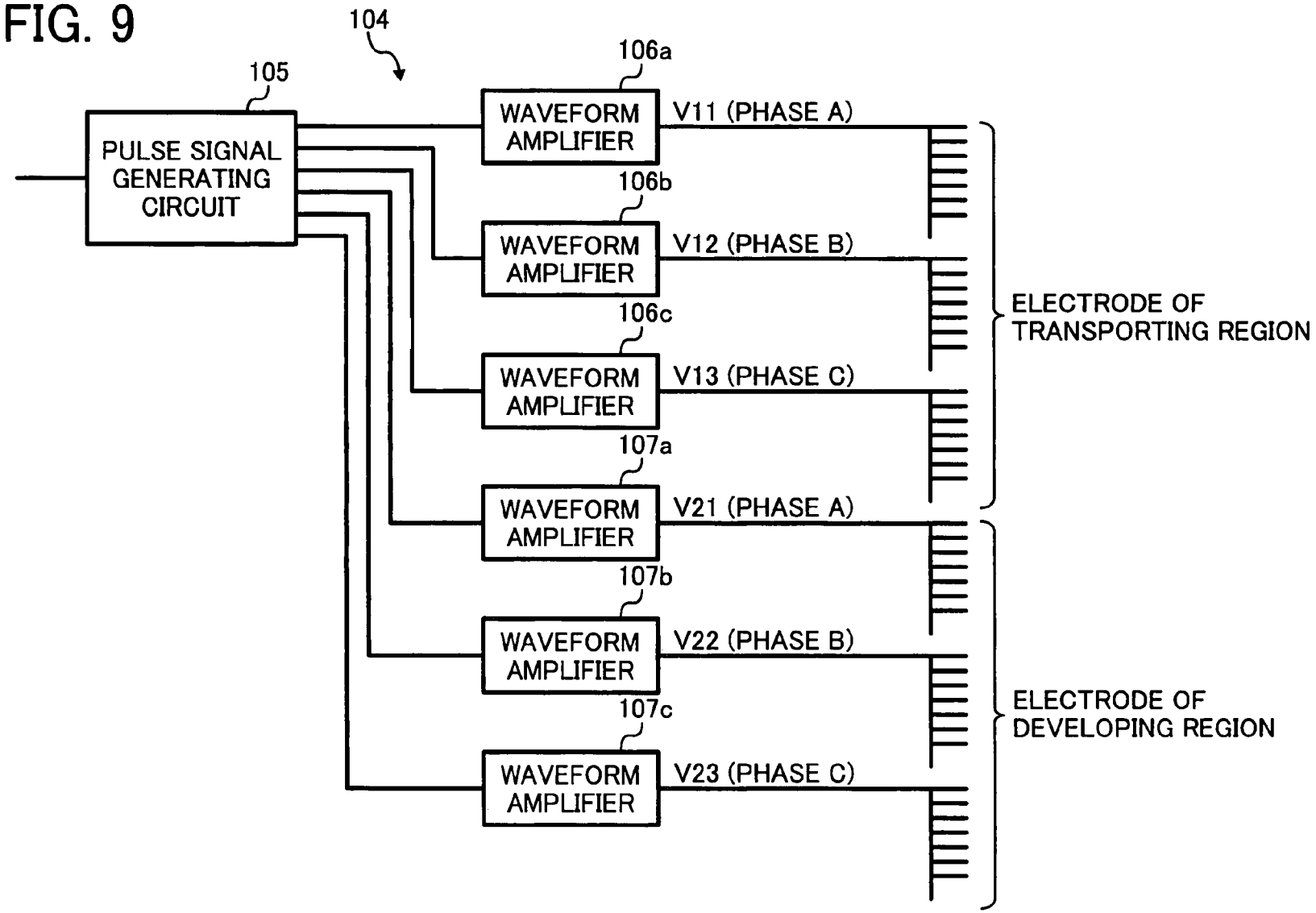
FIG. 9 schematically shows the power supply.

Next, the power supply 104 is described. FIG. 9 schematically shows the power supply 104 (transporting electric source 12).

The power supply 104 comprises a pulse signal generating circuit 105, waveform amplifying circuits 106*a*, 106*b*, 106*c*, and waveform amplifying circuits 107*a*, 107*b*, 107*c*. The pulse signal generating circuit 105 generates and outputs a pulse signal. The waveform amplifying circuits 106*a*, 106*b*, 106*c* receive the pulse signal form from the pulse signal generating circuit 105, and then generate and output driving waveforms V11, V12, V13, respectively. The waveform amplifying circuits 107*a*, 107*b*, 107*c* receive the pulse signal form from the pulse signal generating circuit 105, and then generate and output driving waveforms V21, V22, V23.

The pulse generating circuit 105, for example, receives an input pulse with a logic level, and then uses two pulses whose phases are shifted by 120° each other to generate and output a pulse signal with an output voltage level of about 10V to 15V. This generated pulse signal is able to drive a switching device (e.g., a transistor circuit) included in the waveform amplifying circuits 106*a*, 106*b*, 106*c* to perform a switching of up to 100V.

The waveform amplifying circuits 106*a*, 106*b*, 106*c* apply the three phase driving waveforms (driving pulses) V11, V12, V13 to each electrode 102 (the first electrode 102*a*, the second electrode 102*b*, the third electrode 102*c*) of the transporting region. In contrast, the waveform amplifying circuits 107*a*, 107*b*, 107*c* apply the three phase driving waveforms (driving pulses) V21, V22, V23 to each electrode 202 (the first developing electrode 202*a*, the second developing electrode 202*b*, the third developing electrode 202*c*) of the developing region.

Figure 10:
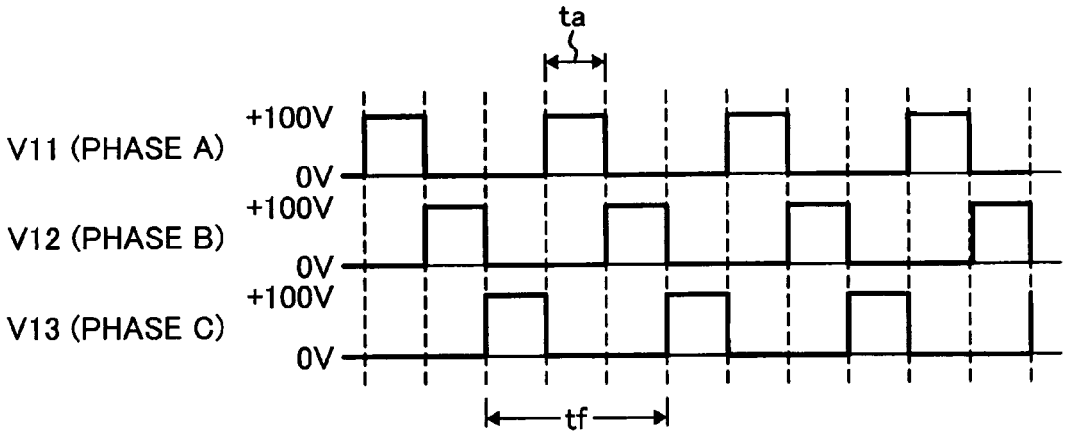
FIG. 10 shows a waveform chart of three phase driving pulse voltages which are applied to the electrode of the electrostatic transporting roller in the transporting region.

FIG. 10 shows a waveform chart of phase A driving pulse voltage, phase B driving pulse voltage, and phase C driving pulse voltage which are applied to the electrode 102 of the electrostatic transporting roller 2 in the transporting region.

In the printer 510, in the transporting region of the electrostatic transporting roller 2, three phase driving waveforms (driving pulses) are applied to the electrode 102. More specifically, as shown in FIG. 10, an applying time ta, which is a time of applying +100V for each phase, is set to about 33% of cycle length time tf. This setup is called a transporting voltage pattern. This waveform is suitable for high-speed transporting of toner particle in a transporting region.

Figure 11:
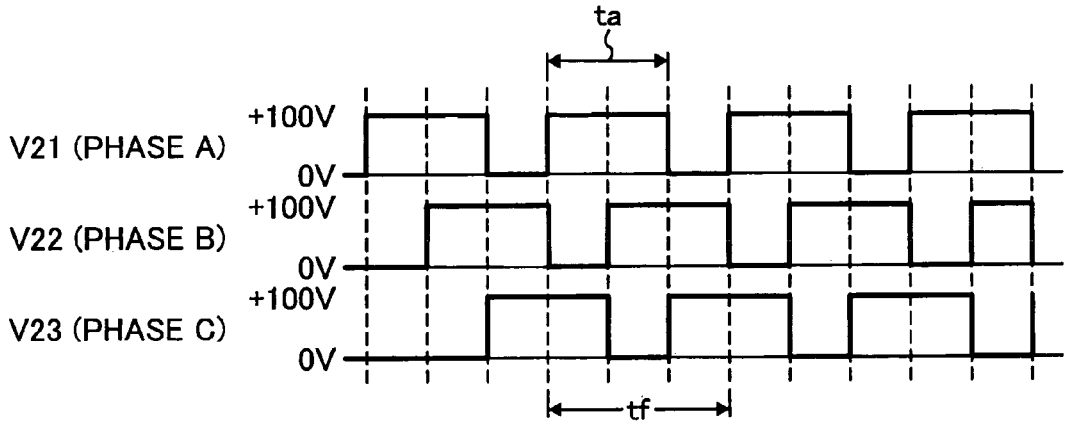
FIG. 11 shows a waveform chart of three phase driving pulse voltage which are applied to the electrode of the electrostatic transporting roller in the developing region.

FIG. 11 shows a waveform chart of phase A driving pulse voltage, phase B driving pulse voltage, and phase C driving pulse voltage which are applied to the electrode 102 of the electrostatic transporting roller 2 in the developing region.

In the developing region, as shown in FIG. 11, an applying time ta, which is a time of applying +100V or 0V for each phase, is set up about 67% of cycle length time tf. This setup is called a developing voltage pattern. The first developing waveform V21, the second developing waveform V22, and the third developing waveform V23 are applied to electrodes 202. In developing region, it is preferable that a toner particle is adhered more strongly to the image bearing member. The waveform shown in FIG. 11 is suitable for adhering a toner particle to the image bearing member.

Even if the driving waveform of developing voltage is applied, a toner receives a lateral force also, except for a toner which exists on the center of an electrode with 0V applied. So all of the toners are not adhered highly all at once, some toners move laterally. On the contrary, even if the driving waveform of transporting voltage is applied, some toners, which are adhered in an oblique direction at large degrees, the vertical moving distance is larger than the horizontal moving distance.

Consequently, the driving waveform applied to each electrode 102 in transporting region is not limited to the transporting pattern depicted in FIG. 10. The driving waveform applied to each electrode 102 in developing region is not limited to the developing pattern depicted in FIG. 11 either.

Thus, a case of three phases is explained as a plural phase driving waveform. The following is an explanation of generalization to n phases. In case that a traveling wave electric field is generated by applying a pulsing voltage (driving waveform) of n phases (n is an integer more than 3) to each electrode, applying electric voltage with a duty cycle {cycle length time×(n−1)/n} increases the efficiency of transportation and development. For example, in a case of using a three phase driving waveform, it is preferable that applying time ta about each electrode is set up to under about 67% of cycle length time tf. In a case of using four phases driving waveform, it is preferable that applying time ta about each electrode is set up to under about 75% of cycle length time tf.

On the other hand, it is preferable that the applied electric voltage is set up to more than the {cycle length time/n}. For example, in case of using three phases driving waveform, it is preferable that applying time ta about each electrode is set up to more than about 33% of cycle length time tf.

In other words, it improves efficiency if a relationship of electric voltage applying times is set up, among electric voltages applied to target electrodes, where electric voltages are applied to the upstream adjacent electrode and the downstream adjacent electrode in the direction of transportation such that the upstream adjacent electrode repels toner and the downstream adjacent electrode attracts toner. Especially, when driving frequency is high, setting to a range under {cycle length time×(n−1)/n} and more than {cycle length time/n} makes it easier to get a desirable initial velocity of toner on the target electrode.

When a hopping toner is made to adhere to a latent image on an image bearing member as mentioned above, it becomes a major issue that stable amount of toner transported by an electrostatic transportation device is gained, and the amount of toner adhered to the image bearing member is stabilized.

In EH development, a toner within a developing region is attracted with an electric field formed by a latent image on an image bearing member, and thus is adhered to the image bearing member. Accordingly, a toner within a developing region does not require a force which a toner trapped by carrier needs to overcome to break the adherence to a carrier and to go toward the latent image. In fact, EH development is a developing method which is highly responsive to electric fields.

Figure 12:
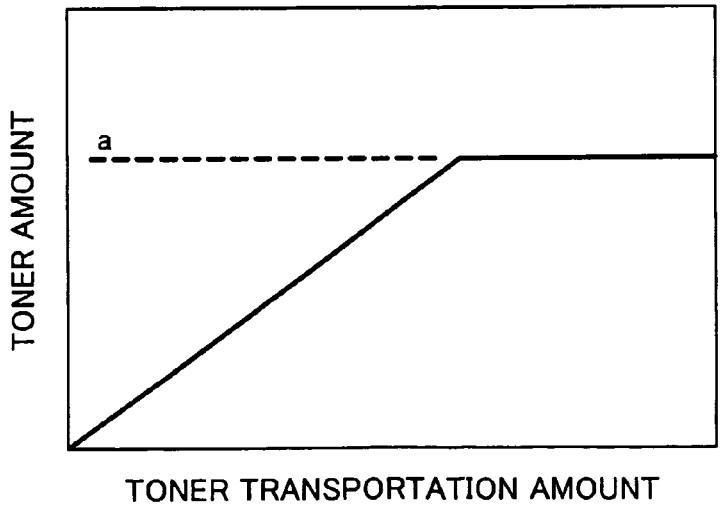
FIG. 12 shows the relationship between the amount of toner transported to the developing region and the amount of toner adhered on the image bearing member.

FIG. 12 shows the relationship between the amount of toner transported to the developing region and the amount of toner adhered on the image bearing member. In FIG. 12, the horizontal axis is the amount of toner transported to the developing region per second per unit width, and the vertical axis is the amount of toner adhered on the image bearing member per unit area when a latent image for solid image is formed and developed.

The amount of toner increases and reaches the quantity of electric charge to fill in the latent image totally, and then is saturated at the amount "a." The amount of toner increases in a linear fashion until saturation. In fact, the amount of toner changes with the variation of the transportation amount. Consequently, it is important to control the amount of toner adherence by detecting and controlling the amount of transportation.

In addition, when the amount of toner is supplied to the developing region, there is the following drawback regarding the method in which a pattern image is formed on a photo conductor for the detection, similar to the drawback in the apparatus using the conventional development method. In fact, the amount of toner adherence on a photo conductor is affected by the electrostatic characteristic of a photo conductor, conditions of charge and exposure, etc., not only by amount of toner transported to the developing region. Further, because toner is expended for detection of the amount of toner transportation, some bad effects result, such as overloading the cleaner, low yield rate of toner, etc. In the case of using a photo conductor whose radius is small, there is not enough space to locate the sensor on a part of the circumference.

Thus, in printer 510, the construction is adopted to detect the amount of toner transportation on the electrostatic transporting device.

Next, a construction to detect the amount of toner transportation in the electrostatic transporting roller 2 as an electrostatic transporting device is discussed.

Figure 13:
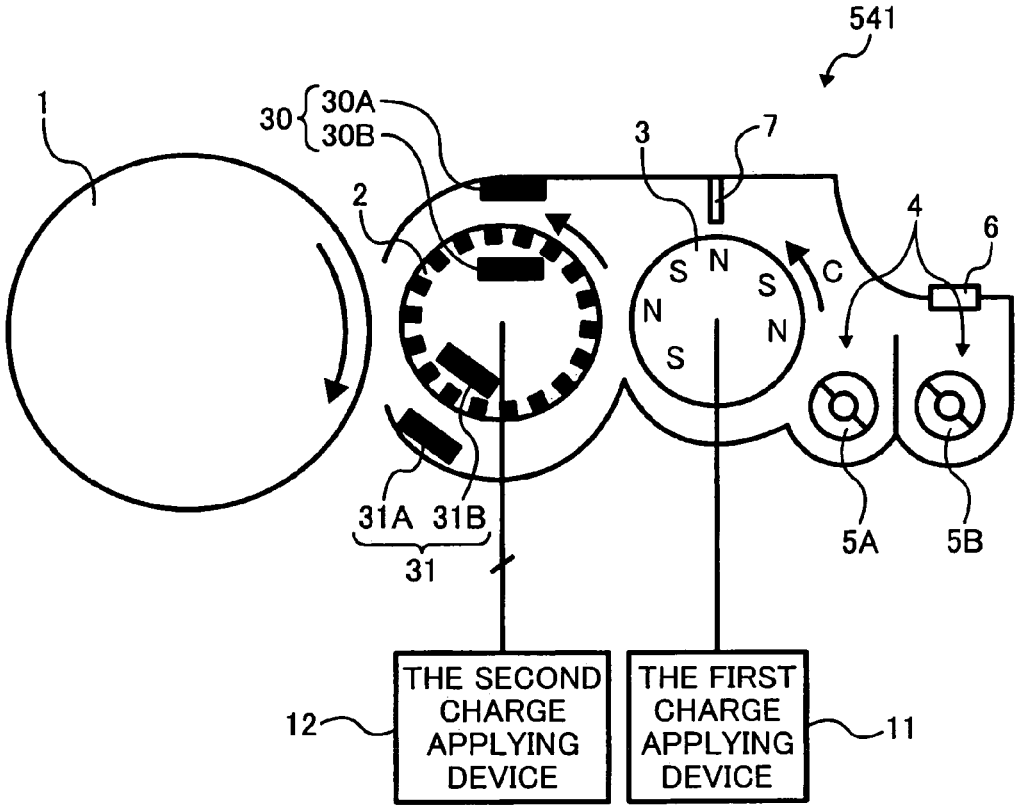
FIG. 13 shows the developing apparatus including a transportation amount sensor.

FIG. 13 schematically shows the developing apparatus 541 which has a transportation amount sensor as a toner transportation amount sensing device.

In FIG. 13, the first transporting sensor 30 is comprised of the first lighting part 30A as a light source and the first light receiving part 30B. The first lighting part 30A and the first light receiving part 30B are located so as to face each other across the surface of the electrostatic transporting roller 2. The portion of the electrostatic transporting roller 2 sandwiched between the first lighting part 30A and the first light receiving part 30B serves as a light transmitting part made of a material having a light transmittance property so as to transmit the light illuminated by the first lighting part 30A. Then, as the amount of toner transportation is getting larger, the amount of light, which incident to the light receiving part, is reduced.

The developing apparatus 541 shown in FIG. 13 includes not only the first transporting sensor 30, which is located upstream of the portion where the electrostatic transporting roller 2 faces to the photo conductor 1 in the direction of toner transportation, but also the second transporting sensor 31, which is located downstream of the portion where the electrostatic transporting roller 2 faces to the photo conductor 1 in the direction of toner transportation. In common with the first transporting sensor 30, the second transporting sensor 31 is comprised of the second lighting part 31A as a light source and the second light receiving part 31B. The second lighting part 31A and the second light receiving part 31B are located so as to face each other across the surface of the electrostatic transporting roller 2.

In the developing apparatus 541 showed in FIG. 13, a light transmittance type sensor is used as a toner transportation amount sensor. The light source and the light receiving part are adopted to face each other across the part where toner is transported. However, the type of sensor used in the present invention is not limited to the above embodiment. It is applicable that a light reflection type sensor is used as a toner transportation amount sensor. In that case, light is incident on the toner layer formed on the toner transporting device from a lighting device located above, and detected by a receiving device located above same as the lighting device.

A measurement with the transmission type method needs to make the transporting device of a light transmitting material. A measurement with the reflection type method needs to make the transporting device of a material which shows a measurable contrast between signals according to whether there is a toner or not.

Next, a construction to change the amount of toner which is supplied onto the electrostatic transporting roller 2 based on the amount of toner detected by the transporting sensor is explained.

Figure 14A:
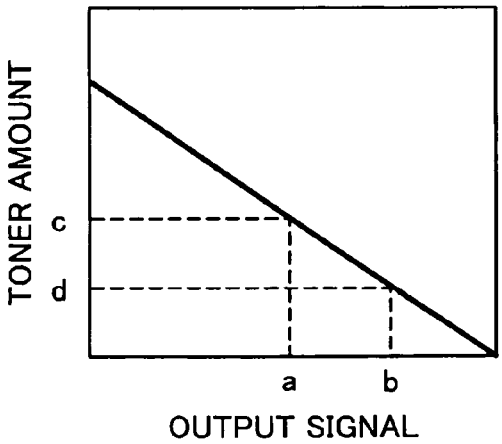
FIG. 14A shows the value of the output signal for the amount of toner transportation on the electrostatic transporting roller.
Figure 14B:
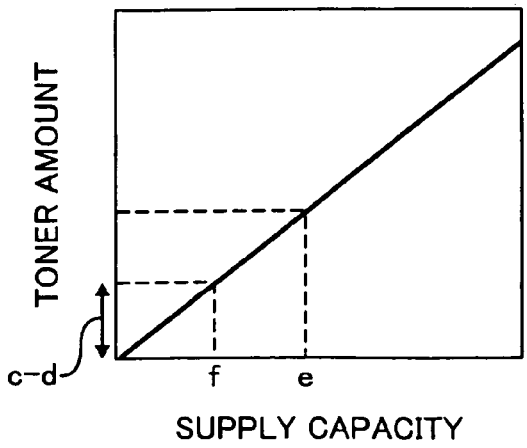
FIG. 14B shows the amount of toner transportation on the electrostatic transporting roller for the toner supply capacity.

FIG. 14A and FIG. 14B respectively show a relationship between the amount of toner vs. an output signal, and a toner supply capacity vs. the toner amount. More specifically, FIG. 14A shows the value of the output signal (the horizontal axis) for the amount of toner transportation on the electrostatic transporting roller 2 (the vertical axis). FIG. 14B shows the amount of toner transportation on the electrostatic transporting roller 2 (the horizontal axis) for the toner supply capacity (the vertical axis).

The toner supply capacity is determined based on various kinds of parameters relating the toner transportation on the electrostatic transporting roller 2. In a case of supplying toner using the construction shown in FIG. 13, the amount of toner transportation can be adjusted by controlling the following parameters, such as the rotation rate of the supplying roller 3, the applied voltage to the supplying roller 3, or the gap between the supplying roller 3 and electrostatic transporting roller 2, etc.

The initial value of the detected signal is indicated "a" in FIG. 14A. if the detected signal is "b" at a certain point, the amount of toner transportation would decrease from "c" to "d". At this time, the supplying part needs to supply "c-d" which is the amount of expended toner, and then the supply capacity comes to "f".

The initial value of the toner capacity is indicated as "e" in FIG. 14B. The toner supply capacity is changed between the range from "0" to "e" based on the amount of expended toner. In addition, it becomes possible also to control the toner so as to change the target amount of toner transportation depending on conditions, not only to control for recovering the above mentioned initial state as the target state.

Locating sensors, such as the first transporting sensor 30 and the second transporting sensor 31, which detect the amount of toner transportation at each side of the developing region enable detection of the expended toner for developing by comparing the signals from both sensors.

It becomes possible also to detect the expended toner for developing, without more than two sensors, by comparing the signals generated in case of using toner for developing and the toner not used.

Figure 15:
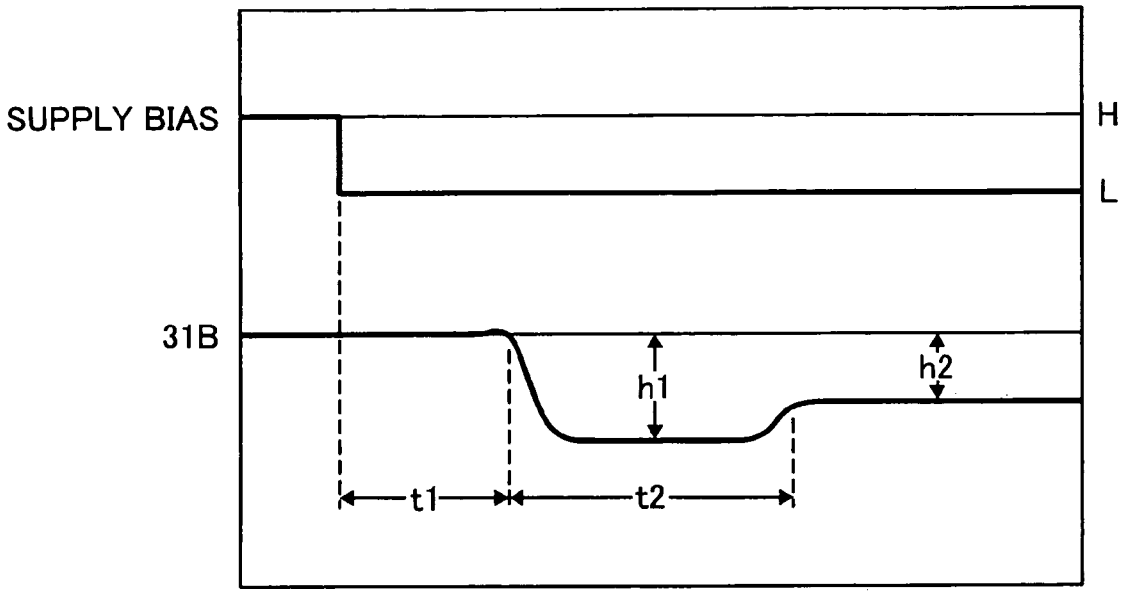
FIG. 15 is an explanatory for describing a signal from the transporting sensor which is located downstream of the developing region in the direction of toner transportation.

For example, FIG. 15 shows a signal from the second light receiving part 31B of the second transporting sensor 31 which is located downstream of the developing region in the direction of toner transportation.

A supplying bias is an output signal of an applied bias applied to the supplying roller 3 by the supplying electric source 11 in FIG. 13. When the supplying bias is "L", the supplying bias is "ON" and then toner is supplied to the electrostatic transporting roller 2.

The time "t1" indicates the time between the moment when the supplying bias turns on and the moment when toner, which is hopping and transported, reaches the sensor position. The toner signal h1 is generated during the period t2 where the toner is not used for development, because the toner starts to develop the image on the photo conductor 1 after the toner, hopping and transported on the electrostatic transporting roller 2, reaches the developing position. Therefore, the amount of expended toner for development can be detected by comparing the signals h1 and h2 generated at the region where the toner is used for development.

Consequently, controlling the supply capacity based on the above the amount of expended toner enables keeping the proper amount of toner on the transporting substrate.

Figure 16:
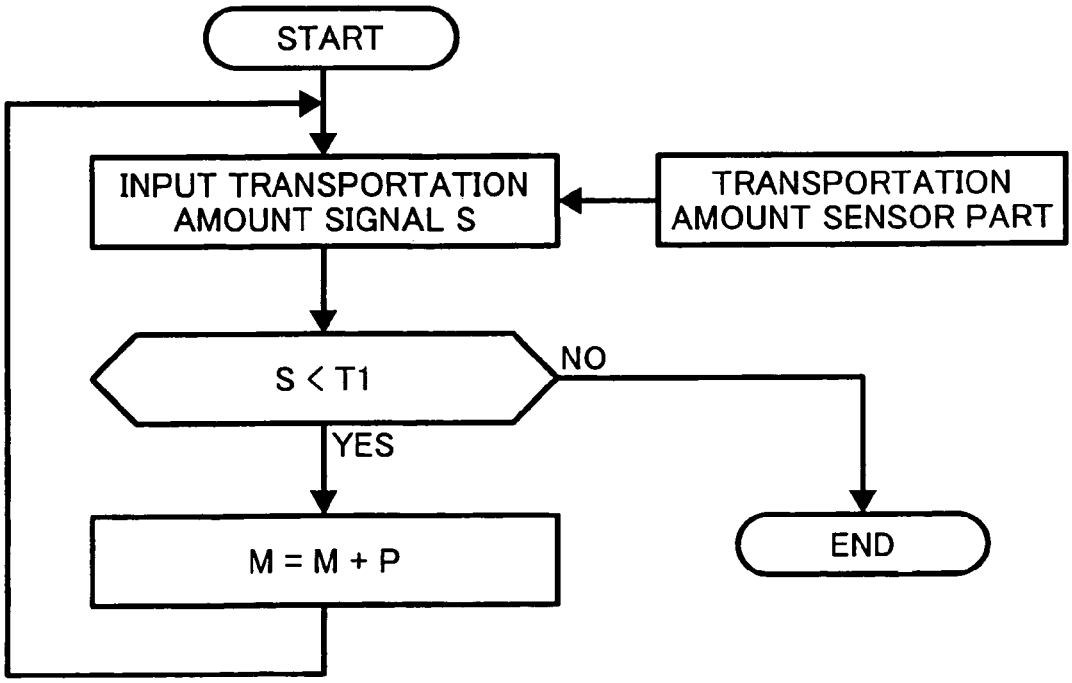
FIG. 16 shows a flowchart for controlling the amount of toner supplied.

Next, an instance of the method for controlling the amount of toner supply is explained. FIG. 16 shows a flowchart for controlling the amount of toner transportation based on an output of a sensor.

The method of controlling is selectable from various kinds of methods. In FIG. 16, a variation width per single procedure of supply is fixed as "P". The input signal S from the transporting part is compared with the target value T1, and then the amount of toner supply is increased by P in case that S is smaller than T1.

This control is performed at a determined timing. This controlling method enables avoiding an immediate change of the amount of toner transportation, resulting in an improved continuousness of the image density. In FIG. 16, the target value is fixed. However, the target value T1 can be changed according to various kinds of predetermined parameters, such as a type of the image, a setting of image density, etc. For example, in case of a photographic copy, a larger T1 than case of character copy makes controlling for proper condition easier.

Figure 17:
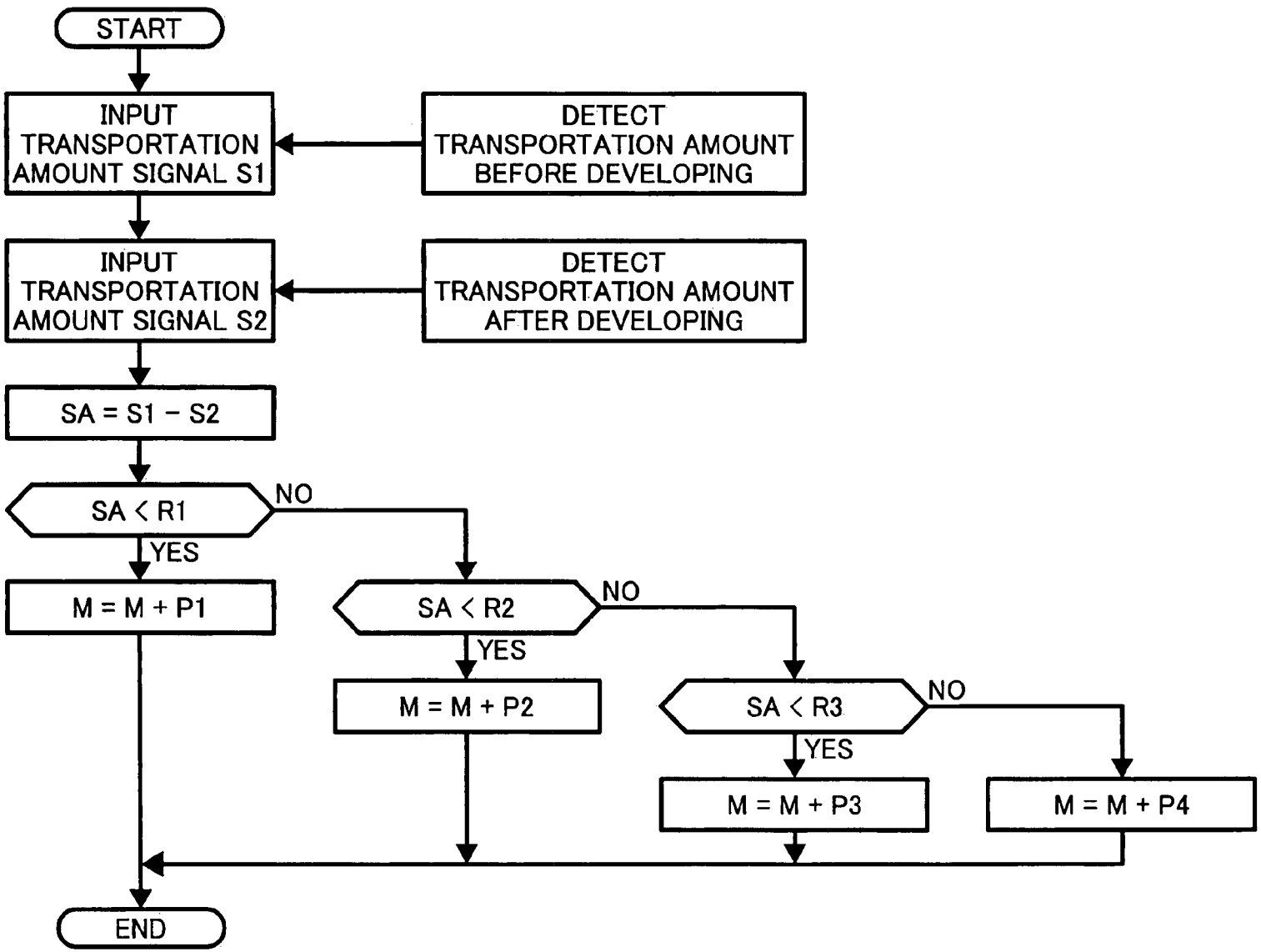
FIG. 17 shows a flowchart for controlling the amount of toner supplied based on a detecting signal of the amount of toner transported before developing and a detecting signal of the amount of toner transported after developing.

An example of a method for controlling is explained in case that the amount of toner supply is determined based on a detecting signal of the amount of toner transportation before developing and a detecting signal of the amount of toner transportation after developing. FIG. 17 shows a flowchart for controlling the amount of toner supply based on a detecting signal of the amount of toner transportation before developing and a detecting signal of the amount of toner transportation after developing.

In FIG. 17, the amount of expended toner SA=S1−S2 is divided to four levels by comparing with comparison signals R1, R2, and R3 (R1<R2<R3). An amount of toner supply of each level is P1, P2, P3, and P4 respectively. Comparison signals R1-R3, and the amount of toner supply P1-P4 are settable variously, and can be changed according to environmental conditions or image conditions. Further, referring to a table of for setting these parameters for determining is effective in making the controlling easier.

In addition, detecting a speed of toner transportation is effective in figuring out conditions of the substrate or the toner. More specifically, the speed of toner v is determined by the pitch of the electrodes, the frequency of the driving voltage, and a number of the phase n. However, if adherence is stronger due to some reasons, such as degradation of toner, degradation of the surface of substrate, or change of environmental moisture, the speed of toner transportation is slower than normal speed. So detecting the speed of toner transportation becomes possible thorough this phenomenon as will be described in further detail below.

Figure 18:
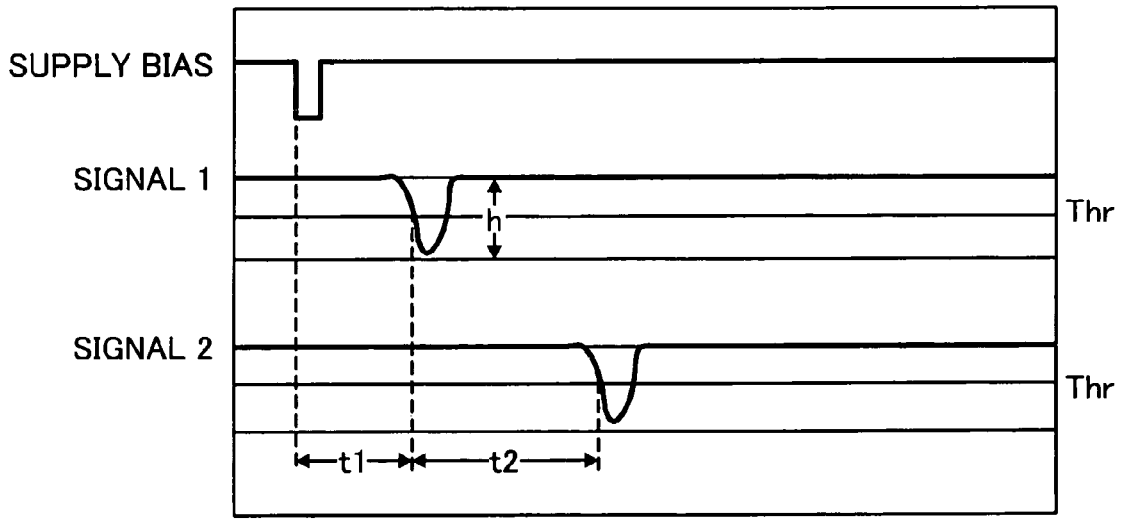
FIG. 18 shows signals for measuring the speed of toner transportation.

FIG. 18 shows an example of signals used for measuring the speed of toner transportation.

In this measurement, the result of detecting by the first transporting sensor 30 and the second transporting sensor 31 is indicated. This result was obtained under circumstances that toner is transporting while the supplying electric source 11 is ON and then applying the supplying bias to the supplying roller 3 for only one second with applying the transporting voltage to the transporting electric source 12. A signal detected by the first light receiving part 30B is indicated by "signal 1", and a signal detected by the second light receiving part 31B is indicated by "signal 2".

The depth of root "h" indicates the amount of toner. The speed of toner transportation is expressed as "d" which is a distance between the two detecting parts divided by "t" which is a space between the moment when toner is detected by signal 1 and the moment when toner is detected by signal 2.

When the space between the signals is calculated, as shown in FIG. 18, digitizing when the toner reaches each sensor is performed by comparing the output of each sensor with the threshold. Therefore, the amount of toner transportation can be derived from the level of signals even in case that the toners are transported continuously along with a practical development.

Example of an Experiment

The moment-to-moment change of print density was verified in an experimental condition of varying type of valuation image and supply method with the printer 510 shown in FIG. 1.

In experiment 1, a mono color image was output. More specifically, only the magenta unit was operated and the other units had no effect on the magenta image. After the image bearing member was charged to −200V, the charged electric potential was attenuated selectively by exposing the image bearing member with a laser, and then the latent image was formed on the image bearing member. The most attenuated electric potential on the image bearing member was −40V. The image bearing member was rotated at speeds of 30 mm/s. the transporting electrodes were applied with the alternate voltage at from 0V to −100V and 4 kHz frequency. Printing was performed continuously and print density was measured. The experimental conditions are shown in Table 1.

TABLE 1

| Experimental conditions | Valuation image | Supplying method |
|---|---|---|
| Condition A | Dot (1 by 3) | Given quantity |
| Condition B | Dot (1 by 3) | Given quantity after once-adjustment |
| Condition C | Solid image | Given quantity after once-adjustment |
| Condition D | Solid image | Detect and control |

Figure 19:
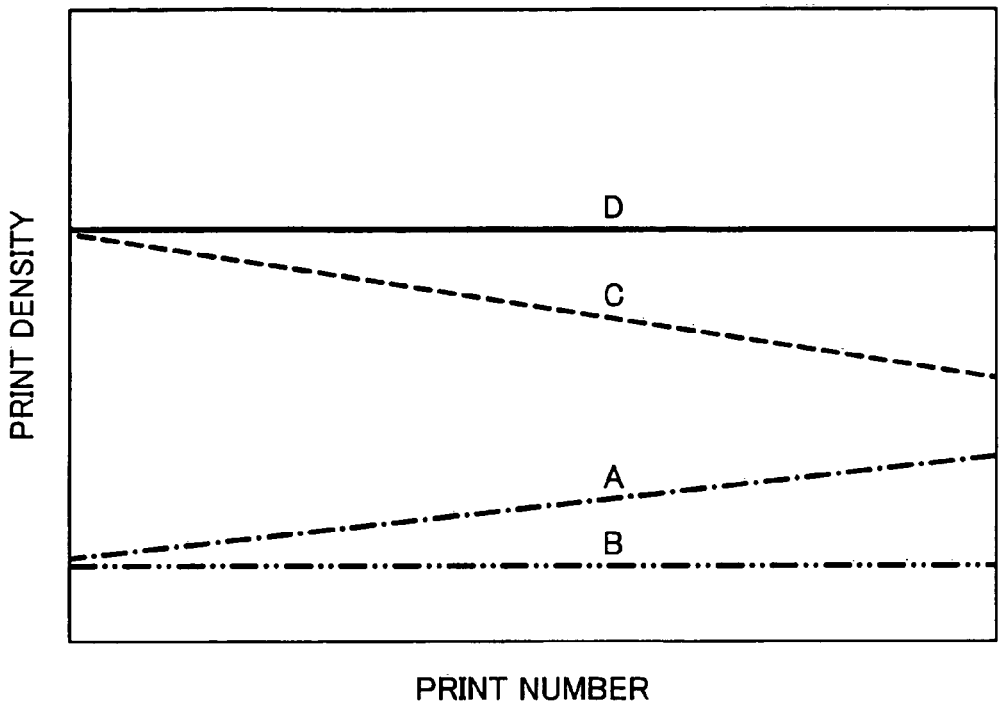
FIG. 19 shows a chart of the result of a first experiment.

FIG. 19 shows a chart of the result of experiment 1.

For condition A, controlling according to the amount of toner transportation is not performed, and printing a 1 by 3 dot image, which is an image formed from one dot at intervals of three dots, is performed continuously. As shown in FIG. 19, image density increased with increasing of print number.

On the other hand, for condition B, printing was performed after adjusting the amount of toner supply once to an amount so as not to increase image density when printing a 1 by 3 dot image. The image density kept stable.

For condition C, printing a 100% solid image was performed in the same supplying method as condition B. Image density decreased a short time later and an adequate solid image density could not be gained.

On the other hand, for condition D, printing was performed with adjusting the supplying bias in order that the signal from the amount of toner detecting part becomes a certain value corresponding to a target amount of toner. Image density was kept in a good condition. In the same supplying method, dot image was in a good condition also.

According to the above the first embodiment, in an electrostatic transferring apparatus which has the electrostatic transporting roller 2 as a powder transferring device including a plurality of electrodes to generate an electric field for transporting and making hop a toner, which is a powder, by an electrostatic force, the first transporting sensor 30 and the second transporting sensor 31 as a powder transferring amount detecting device to detect an amount of powder which move on the electrostatic transporting roller 2 are located on the electrostatic transporting roller 2.

This construction provides an improved accuracy of the detection. Therefore adherence of an excessive amount of toner is not necessary. Consequently, it enables reducing the amount of toner expended wastefully.

In the developing apparatus 541, which includes the electrostatic transporting roller 2 including a plurality of electrodes to generate a traveling wave electric field for moving the toner and the transporting electric source 12, and develops a latent image on the photo conductor 1 by adhering toner, the first transporting sensor 30 and the second transporting sensor 31 as a powder transferring amount detecting device to detect an amount of powder which move on the electrostatic transporting roller 2 are located on the electrostatic transporting roller 2.

This construction provides a direct detection of the amount of toner on the electrostatic transporting roller 2. Therefore this direct detection enables an improved accuracy of the detection for the amount of toner on the electrostatic transporting roller 2.

As powder transferring amount detecting device, the first transporting sensor 30 and the second transporting sensor 31 are used. They are comprised of a light source and a device for detecting the light quantity respectively, and located in order that the detected light quantity depends on the amount of toner transferring.

This construction provides an easy method for detecting an amount of toner.

In addition, the electrostatic transporting roller 2 transmits at least a part of light illuminated by the light source. The first lighting part 30A and the second lighting part 31A, and the first light receiving part 30B and the second light receiving part 31B as devices to detect a light quantity are located at positions where they respectively face each other across the toner transferring device.

This construction provides an easy method for detecting an amount of toner.

In the developing apparatus 541, the amount of toner supplied to the electrostatic transporting roller 2 as a toner electrostatic transferring device is controlled based on a detection result of the first transporting sensor 30 and the second transporting sensor 31 as a toner transferring amount detecting device.

This construction enables a supply of a stable amount of toner to the developing region, and provides a stable image density.

The second transporting sensor 31 is located downstream of the portion where the electrostatic transporting roller electrostatic transporting roller 2 faces the photo conductor 1 in the direction of toner transportation.

This construction enables detecting an amount of toner used for development, and evaluating a condition of development.

Furthermore, detecting an amount of toner used for development and controlling an amount of toner supplied to the toner transporting devise based on the amount of toner enable keeping a stable development condition.

In the printer 510 as an image forming apparatus, the developing apparatus 541 detects the amount of toner transferring, and controls an amount of toner supplied to the electrostatic transporting roller 2 based on the amount of toner transferring.

This construction enables stable image forming.

Modified Experiment 1

In the first embodiment, the developing apparatus uses a bi-component developer comprised of a magnetic carrier and a non-magnetic toner. However, a design where the amount of toner transportation is detected on the electrostatic transporting device is applicable to a developing apparatus using a one-component developer.

Hereinafter, as modified experiment 1, a developing apparatus using a one-component developer can be used with a design where the amount of toner transportation is detected on the electrostatic transporting device.

Figure 20:
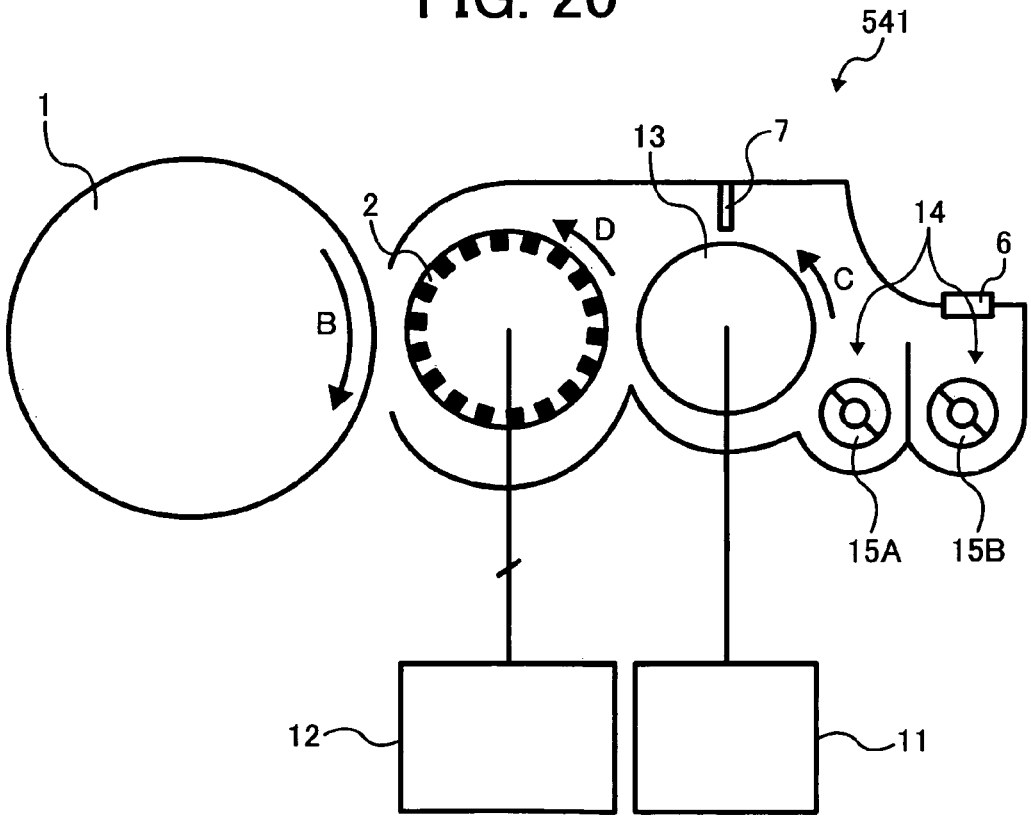
FIG. 20 shows the developing apparatus which includes the transportation sensor related to a modified experiment.

FIG. 20 schematically shows the developing apparatus 541 and the photo conductor 1 related to the modified experiment.

The developing apparatus 541 shown in FIG. 20 is a developing apparatus using a one-component developer comprised of non-magnetic toner. The developing apparatus 541 has the electrostatic transporting roller 2 which is a roller-shaped electrostatic transporting device including plural electrodes to generate an electric field for transporting, developing, and recovering toner particles. During image processing, the electrostatic transporting roller 2 is placed opposite the photo conductor 1 in non-contacting state with a distance of 50-1000 micrometers therebetween, optimally 150-400 micrometers. In addition, the electrostatic transporting roller 2 includes the supplying roller 3 which is located on a position opposite to the electrostatic transporting roller 2 for supplying toner to the electrostatic transporting roller 2, and a developer storing part 14 which stores toner supplied by the supplying roller 3. In this case, the electrostatic transporting roller 2 is located so as to face both of the photo conductor 1 and the supplying roller 3 through respective intermediary regions. Each region is placed on opposite side of the electrostatic transporting roller 2. In other words, the electrostatic transporting roller 2 is located between the photo conductor 1 and the supplying roller 3. The electrostatic transporting roller 2 does not rotate. On the external surface of the electrostatic transporting roller 2, toners are transported by the transporting electric field (phase shifted electric field) in the direction of the arrow D in FIG. 20. On the contrary, the supplying roller 3 in the direction of the arrow depicted with the arrow D in FIG. 20. In contrast, the supplying roller 3 rotates in the direction of the arrow C in FIG. 20

The toner storing part 14 has toner resupplying rollers 15A and 15B. The developer is drawn to the surface of the supplying roller 3 by electrostatic force generated from frictional electrification of the toner resupplying roller 15A and the supplying roller 3. The toner on the supplying roller 3 is thinned by the developer layer thickness controlling device 7, and then, is carried to the region where the supplying roller 3 faces the electrostatic transporting roller 2.

A supplying bias is applied to the supplying roller 3 by a supplying electric source 11 as the first charge applying device. An electric voltage is applied to the electrodes of the electrostatic transporting roller 2 by a transporting electric source 12 as the second charge applying device. Bias applied by the supplying electric source 11 and the transporting electric source 12 is the same as the first embodiment.

Consequently, in the region where the supplying roller 3 and the electrostatic transporting roller 2 face each other, an electric field is generated between the supplying roller 3 and the electrostatic transporting roller 2 by the supplying electric source 11 and the transporting electric source 12. Under the influence of the electrostatic force from this electric field, toner separates from the supplying roller 3 and moves to the surface of the electrostatic transporting roller 2. Then, the toner which reaches the surface of the electrostatic transporting roller 2 is transported by hopping on the surface of the electrostatic transporting roller 2 by the transporting electric field generated by the electric voltage applied by the transporting electric source 12.

In addition, in the developing apparatus 541, a toner transporting apparatus, which serves as a fine particle transporting apparatus, includes the electrostatic transporting roller 2 and the transporting electric source 12.

The toner transported to the region where the toner faces to the photo conductor 1 moves onto the photo conductor 1 and develops the latent image on the photo conductor 1 by the developing electric field between the electrostatic transporting roller 2 and the image portion on the photo conductor 1.

As described above, a one-component developer comprised of toner can be used as a developer. In a case of a bi-component developer, a part of carriers forming the magnetic ear may be cut and moved toward the toner transporting device, and then adhered to the surface of the toner transporting device in the toner supplying part by rotation of the developer bearing member or the impact of collision of magnetic ear and the toner transporting device. In contrast, in a case of a one-component developer, the problem of adherence to the surface of the toner transporting device does not occur because carriers are not used. In addition, in a case of a one-component developer, construction of the developer storing part can be easier, therefore miniaturization and lower cost of the developing apparatus are possible.

Modified Experiment 2

In the first embodiment, the photo conductors 1 are implemented as an image bearing member corresponding to each color, and toner images of four colors are superimposed on the transfer material P. However, it is applicable that toner images of four colors are developed on one image bearing member in plies, and the developed image is transferred to the transfer material P from the image bearing member simultaneously.

In what follows, an image forming apparatus, which develops the toner image of four colors in plies, and the developed image is transferred to the transfer material P, is explained as the modified experiment 2.

Figure 21:
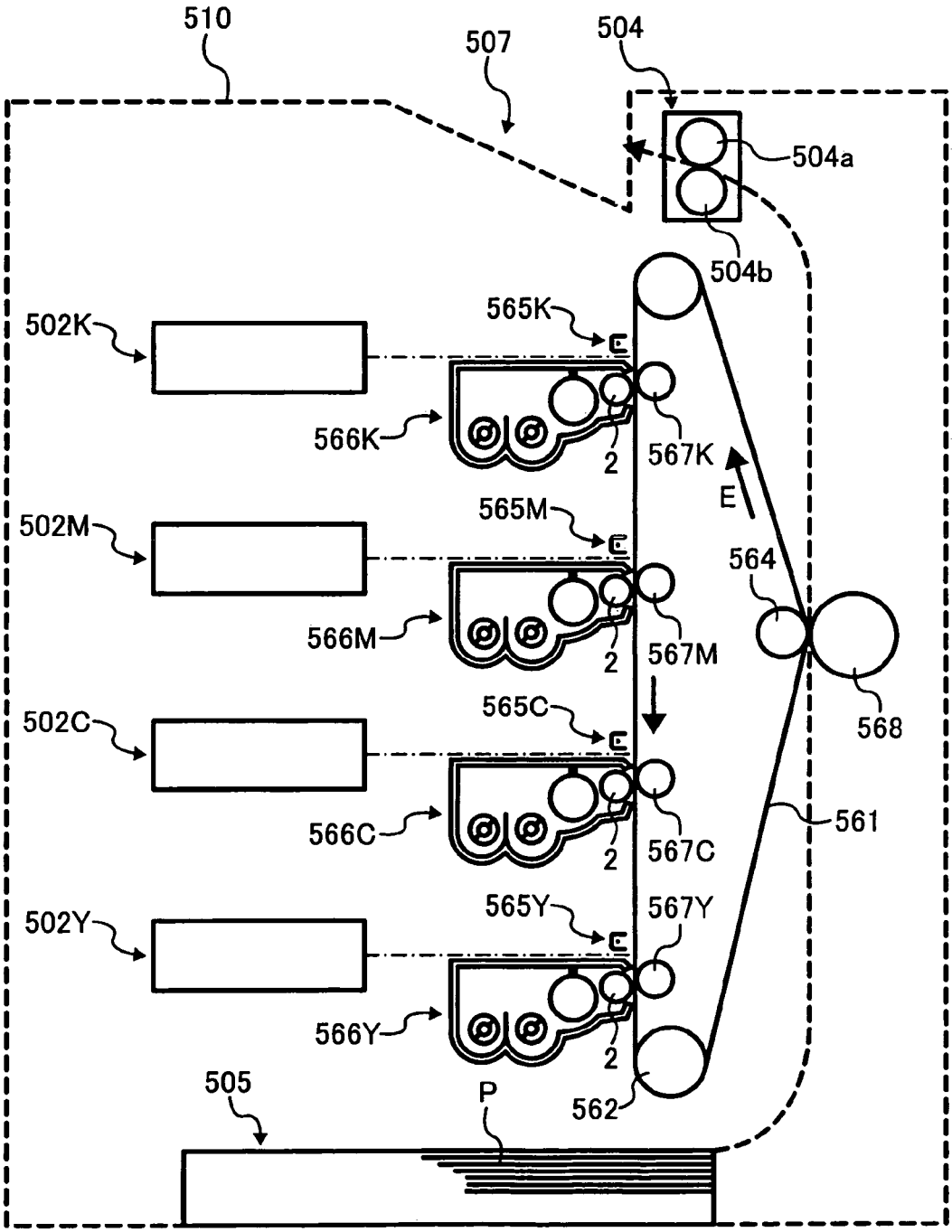
FIG. 21 shows the printer as an image forming apparatus related to the modified experiment.

FIG. 21 schematically shows the printer 510 as an image forming apparatus related to the modified experiment. In FIG. 21, elements which have the same function as in the printer 510 shown in FIG. 2 have the same number, and the explanation thereof is omitted unless necessary.

The printer 510 depicted in FIG. 21 has a belt-shaped organic photo conductor belt 561 which can be charged negatively. This photo conductor belt 561 is tensioned by a photo conductor driving roller 562, a photo conductor driving roller 563, and a batch transferring opposite roller 564, and moved endlessly by a rotation driving mechanism (not shown) in the direction depicted by arrow E.

The following devices face the photo conductor belt 561 per color respectively: chargers 565K, 565M, 565C, and 565Y as charging devices which charge the photo conductor belt 561, and developing cartridges 566K, 566M, 566C, and 566Y which include the developing apparatus 541 developing the latent image on the photo conductor belt 561. These are implemented in order to superimpose each toner image on the photo conductor belt 561 in series in concert with moving of the photo conductor belt 561. In addition, the developing apparatus 541 is designed to detect the amount of toner transportation on the electrostatic transporting roller 2 as an electrostatic transporting device in common with the first embodiment.

Developing opposite rollers 567K, 567M, 567C, and 567Y are located respectively in each position facing each electrostatic transporting roller 2 of the developing opposite rollers 566K, 566M, 566C, or 566Y across the photo conductor belt 561. Furthermore, a batch transferring roller 568 is located in a position which faces the batch transferring opposite roller 564 across the photo conductor belt 561.

The chargers 565 as a charging device charge the surface of the photo conductor belt 561 uniformly. In the printer 510 shown in FIG. 21, a corona charging method is adopted. A non-contact type charging device, such as a corona charging device, enables charging the photo conductor belt 561 without disturbance of toner images formed by each developing cartridge 566 located upstream.

In image forming process, the each charger 565 charges the surface of the photo conductor belt 561 uniformly. Even if a toner image has formed on the photo conductor belt 561, the surface of the photo conductor belt 561 is charged, including the toner image, uniformly. A light beam is illuminated from the writing apparatus 502 according to image information. The light beam passes through between the charger 565 and the developing cartridge 566, and then the light beam illuminates the photo conductor belt 561 charged uniformly. Therefore, electricity of a region corresponding to the image portion is removed, and a latent image is formed.

The developing cartridge 566 adheres toner to the image portion of the latent image formed on the photo conductor belt 561, and then the latent image is developed as a toner image in common with the developing apparatus 541 of the first embodiment. The above processes, that is, charging, illuminating of light beam, and developing, are repeated in opposite part of the each developing cartridge, and then a full color image, which is superimposed on the photo conductor belt 561 with four colors toner image, is formed.

At the same time, the transfer material P is carried to a part where the photo conductor belt 561 and the batch transferring roller 568 contact each other. At this part, the full color image is transferred to the transfer material P with a voltage applied by the batch transferring roller 568. After that, the transfer material P reaches the fixing apparatus 504. The toner image is fixed on the transfer material P by being sandwiched and heated by the heat roller 504*a* and the pressure roller 504*b*, and then the developed full color image is formed on the transfer material P.

In addition, the developing cartridges 566K, 566M, 566C, and 566Y, which develop the toner image of black, magenta, cyan, and yellow, have a removable architecture for the printer 510 as a process cartridge in common with the image processing unit 501 in the first embodiment.

Figure 22:
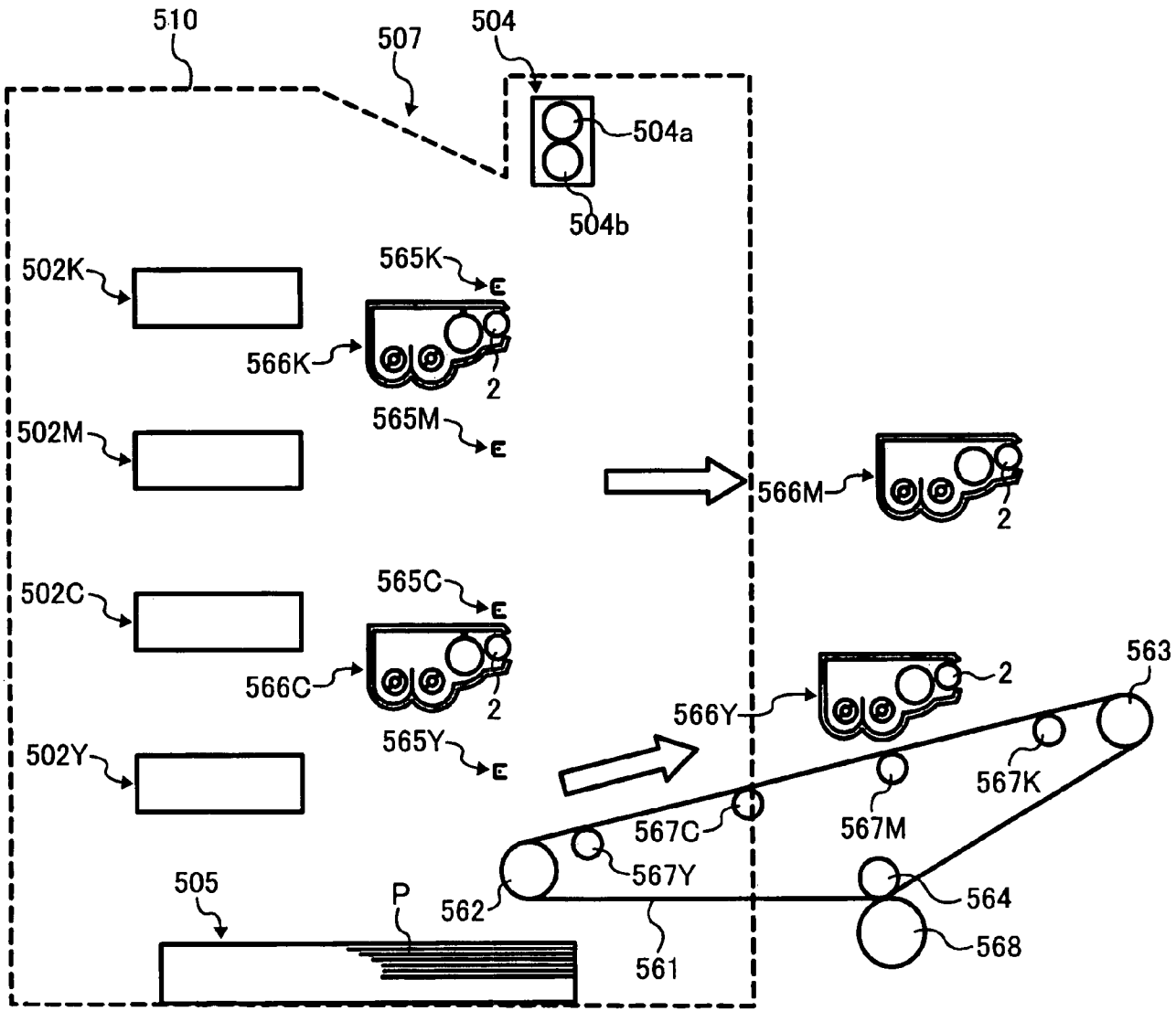
FIG. 22 shows architecture for removal of the developing unit in the printer.

FIG. 22 shows architecture for removal of the developing cartridge 566 as a process cartridge from the printer 510. As shown in FIG. 22, the photo conductor belt 561 is opened and evacuated from the printer 510. This structure enables that the each developing cartridge 566 is removable from the opened space, and then exchange by user.

The above mentioned invention is not limited to the image forming apparatus showed in FIG. 1 and FIG. 21. This invention may have applicability to a color image forming apparatus using an intermediate transfer belt, a transfer drum, or an intermediate drum, or a monochrome image forming apparatus.

While the present invention has been described with a preferred embodiment, this description is not intended to limit the scope of the invention. Various modifications of embodiment will be apparent to those skilled in the art. It is such modifications or embodiments as fall within the true scope of the invention.

The present application is based on and claims priority to Japanese Patent Application No. 2005-216,967 filed on Jul. 27, 2005, the entire contents of which are hereby incorporated herein by reference.

The invention claimed is:

1. A developing apparatus for developing a latent image on a latent image bearing member, comprising:

a toner electrostatic transferring device including a plurality of transferring electrodes configured to generate an electric field for transferring the toner by an electrostatic force, including, a toner transferring amount detecting device to detect an amount of toner on a surface of the toner electrostatic transferring device, wherein the toner on the surface of the toner electrostatic transferring device is transferred to a position which faces the latent image bearing member by being moved relatively along the surface by an electrostatic force, and the toner transferring amount detecting device is located downstream of the portion where the toner electrostatic transferring device faces the latent image bearing member in the direction of toner transportation.

2. The developing apparatus as claimed in claim 1, wherein the toner transferring amount detecting device detects an amount of toner expended for development;

and wherein an amount of toner supplied to the toner transferring device is controlled based on a detection result of the toner transferring amount detecting device.

3. An image forming apparatus provided with a latent image bearing member and a developing device for developing a latent image on the latent image bearing member to a toner image, comprising:

a toner electrostatic transferring device including a plurality of transferring electrodes to generate an electric field for transferring the toner by an electrostatic force; and a toner transferring amount detecting device to detect an amount of toner on a surface of the toner electrostatic transferring device, wherein the toner on the surface of the toner electrostatic transferring device is transferred to an position which faces the latent image bearing member by being moved relatively along the surface by an electrostatic force, and the toner transferring amount detecting device is located downstream of a portion where the toner electrostatic transferring device faces the latent image bearing member in a direction of toner transportation.

* * * * *